US006565333B2

(12) United States Patent
Maruyama

(10) Patent No.: US 6,565,333 B2
(45) Date of Patent: May 20, 2003

(54) FLUID DISCHARGE APPARATUS AND FLUID DISCHARGE METHOD

(75) Inventor: Teruo Maruyama, Hirakata (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/900,136

(22) Filed: Jul. 9, 2001

(65) Prior Publication Data

US 2002/0025260 A1 Feb. 28, 2002

(30) Foreign Application Priority Data

Jul. 10, 2000 (JP) ..... 2000-208072

(51) Int. Cl.[7] ..... F04B 17/04; F04B 23/12; F04B 19/02; F04B 39/08; F04B 39/10

(52) U.S. Cl. ..... 417/417; 417/206; 417/416; 417/469; 417/505; 417/509

(58) Field of Search ..... 417/206, 322, 417/416, 417, 469, 505, 509

(56) References Cited

U.S. PATENT DOCUMENTS 1,172,581 A * 2/1916 Cheney ..... 417/489
2,881,749 A * 4/1959 Pringham ..... 123/187.5
4,750,871 A * 6/1988 Curwen ..... 417/320
4,755,113 A * 7/1988 Rasmussen ..... 417/469
4,927,334 A * 5/1990 Engdahl et al. ..... 310/26
5,104,299 A * 4/1992 Mizuno et al. ..... 417/417
5,303,854 A * 4/1994 Cater ..... 222/321.2
6,077,054 A * 6/2000 Lee et al. ..... 310/15
6,092,999 A * 7/2000 Lilie et al. ..... 417/415

FOREIGN PATENT DOCUMENTS

FR 2 564 525 * 11/1985 ..... F04B/13/00
JP 7-308619 * 11/1995 ..... B05C/5/00
JP 10-128217 5/1998

OTHER PUBLICATIONS

Derwent Abstract of BR 9802892 (Lilie et al.); Mar. 2000.*
"Jidokagijutsu (Mechanical automation)", vol. 25, No. 7, 1993, pp. 71–76.
"Cho–onpa TECHNO (ultrasonic TECHNO)", the June Issue, 1959, pp. 59–63.

* cited by examiner

*Primary Examiner*—Charles G. Freay
*Assistant Examiner*—Timothy P. Solak
(74) *Attorney, Agent, or Firm*—Wenderoth, Lind & Ponack, L.L.P.

(57) ABSTRACT

A positive displacement pump is composed of a first actuator for relatively moving a piston and a housing, a cylinder for accommodating the piston, and a second actuator for relatively moving the cylinder and the housing.

42 Claims, 26 Drawing Sheets

601
602
603
604
606
608
609
610
611
612
613
h1
h2
H1
H2

FLUID DISCHARGE APPARATUS AND FLUID DISCHARGE METHOD

BACKGROUND OF THE INVENTION

The present invention relates to a fluid discharge apparatus, and a fluid discharge method, which are capable of feeding fluid at a minute flow rate with high accuracy in fields such as consumer products, information-processing equipment, equipment for factory automation, and production machines.

With employment of the present invention, a fluid discharge apparatus and a fluid discharge method can be provided which are capable of discharging intermittently or continuously various types of fluid in a constant amount, such as adhesives, solder paste, fluorescent substances, grease, paints, hotmelt, chemicals, and foods. The method and apparatus can also be used in production processes for such fields as electronic components and household electric appliances.

Liquid discharging apparatus (dispensers) have been conventionally used in various fields, and techniques for controlling discharge of a minute amount of fluid material with high accuracy and stability have been demanded with needs for miniaturization and increased recording density of electronic components in recent years.

There is also a great demand for a fluid discharging method for applying fluorescent substances uniformly to display surfaces of a CRT (Cathode Ray Tube) and a PDP (Plasma Display Panel), for example.

In the field of surface mounting technology (SMT), for example, requests of dispensers with regard to trends of speed-up, miniaturization, densification, quality improvement, and automation of mounting are summarized as follows.

(i) increase in accuracy in an amount of application (ii) reduction in discharging time (iii) minimization in an amount of application in one operation (iv) diameter reduction in and miniaturization of a dispenser body (v) equipment with multi-nozzles.

As liquid discharging apparatus, conventionally, such dispensers employing an air pulse system as shown in FIG. 21 have been widely used, and this technique is presented, for example, in "Jidoka-gijutsu (Mechanical automation)", vol. 25, No. 7, '93. A dispenser of this system applies a constant amount of air supplied from a source of a constant pressure into a vessel (cylinder) 150 in pulsed manner, and discharges from a nozzle 151 a certain amount of liquid corresponding to a pressure increase in the cylinder 150.

On the other hand, micropumps employing piezoelectric elements have been developed for a purpose of discharging fluid at a minute flow fate. For example, the following is presented in "Cho-onpa TECHNO (ultrasonic TECHNO)", the June issue, '59. FIG. 22 is a figure of a principle of such a micropump, and FIG. 23 illustrates its concrete structure., Upon application of a voltage to a laminated piezoelectric actuator 200, the actuator undergoes a mechanical elongation, which is magnified by action of a displacement magnifying mechanism 201. Then, a diaphragm 203 is pushed upwardly in FIG. 22 via a thrust-up rod 202, and capacity of a pump chamber 204 therefore decreases. At this time, a check valve 206 in a suction opening 205 closes, and a check valve 208 in a discharge opening 207 opens and fluid in the pump chamber 204 is discharged. Upon a reduction in the applied voltage, subsequently, the mechanical elongation decreases with the reduction in the voltage. The diaphragm 203 is then pulled back downwardly by a coiled spring 209 (by returning action) and capacity of the pump chamber 204 increases and pressure in the pump chamber 204 turns negative. The negative pressure opens the check valve 206 in the suction opening and the pump chamber 204 is filled with fluid. At this time, the check valve 208 in the discharge opening remains closed. The coiled spring 209 has an important role of applying a mechanical pre-load to the laminated piezoelectric actuator 200 via the displacement magnifying mechanism 201, in addition to the action of pulling back the diaphragm 203. After that, the above operations are repeated.

It is thought that a miniature pump having a minute flow rate with excellent accuracy with respect to flow rate can be obtained with the above configuration using a piezoelectric actuator.

Among the above-mentioned prior art, dispensers of air pulse systems had the following issues.

(1) variation in discharge amount resulting from pulsation of discharge pressure (2) variation in discharge amount resulting from a water head difference (3) change in discharge amount resulting from a change in viscosity of liquid.

The shorter cycle time (tact) and discharge time are, the more remarkable the phenomenon of the above-mentioned first issue. Therefore, there have been made such contrivances as provision of a stabilizer circuit for equalizing heights of air pulses.

The above-mentioned second issue occurs for the following reason. Capacity of a cavity 152 in the cylinder varies with a residual quantity H of the liquid, and therefore, a degree of a change in pressure in the cavity 152 caused by discharge of a given amount of high-pressure air varies enormously with the quantity H. As a consequential issue, a decrease in a residual quantity of the liquid reduces an amount of application, e.g., by fifty to sixty percent as compared with a maximum amount. Therefore, remedies that have been adopted include detection of the residual quantity H of the liquid during each discharge operation, and subsequent adjustment of a pulse duration in order to make a discharge amount uniform.

The above-mentioned third issue occurs in a case that viscosity of a material, for example, containing a large quantity of solvent changes with time. As an example of remedies which have been adopted for this issue, a tendency of viscosity change with respect to a time axis is previously programmed into a computer and, for example, pulse length is adjusted so that influence of viscosity change may be corrected.

Any of the remedies for the above-mentioned issues has not served as a fundamental solution, because these remedies complicate a control system including a computer, and have difficulty in accommodating irregular changes in environmental conditions (e.g., temperature).

The following is a predicted issue in adaptation of an above-mentioned piezo-pump, using the laminated piezoelectric actuator shown in FIGS. 22 and 23, to high-speed intermittent application of high viscosity fluid employed in such fields as surface mounting.

In the field of surface mounting, a dispenser which is capable of applying, e.g., not more than 0.1 mg of adhesive (having a viscosity in the range of one hundred thousand to one million CPS) instantaneously within 0.1 sec. has been demanded in recent years. It is therefore presumed that such a dispenser requires a high hydrostatic pressure in the pump chamber 204, and high responsibility of the suction valve 206 and the discharge valve 208 communicating with the pump chamber 204. For a pump equipped with a passive discharge valve and a passive suction valve, however, it is extremely difficult to intermittently discharge rheological fluid, having extremely poor fluidity and high viscosity, with high accuracy in flow rate and at a high speed.

In order to eliminate the above-mentioned defects of an air pulse system, a piezo system employing a laminated piezoelectric actuator and the like, and a pump for a minute flow rate that will be described below, has been already proposed by the inventor(in Japanese Unexamined Patent Publication No. 10-128217).

Suction action or discharge action of this pump is obtained by applying relative linear motion and relative rotational motion between a piston and a cylinder by virtue of independent actuators, and electrically and synchronously controlling operation of the actuators.

In FIG. 24, reference numeral 301 denotes a first actuator composed of a laminated piezoelectric element. Numeral 302 denotes a piston driven by the first actuator 301, and the piston corresponds to a direct-acting part of a pump. Between the piston 302 and a lower housing 303 is formed a pump chamber 304, of which capacity changes with movement of the piston 302 in its axial direction. In the lower housing 303 are formed a suction bore 305 and discharge bores 306*a* and 306*b*, all of which communicate with the pump chamber 304.

Numeral 307 denotes a second actuator that causes a relative rotational or rocking motion between the piston 302 and the lower housing 303, and the second actuator is composed of a pulse motor, a DC servo motor, or the like. Numeral 308 denotes a motor rotor constituting the second actuator 307 and numeral 309 denotes a stator.

A rotating member 310 is connected to the piston 302 via a leaf spring 311 shaped like a disk. The leaf spring 311 has a shape that easily undergoes elastic deformation in an axial direction in order to transmit expansion and contraction of the piezoelectric element, as the first actuator 301, in the axial direction to the piston 302. Rotation of the rotating member 310 is transmitted to the piston 302 via the leaf spring 311. This arrangement permits the piston 302 of the pump to make a rotational motion and a linear motion simultaneously and independently.

Reference numeral 312 denotes a coupling joint for supplying power from an exterior to the first actuator 301 that makes a rotational motion.

A discharge sleeve 314 having a discharge nozzle 313 at a tip is installed on a lower end portion of the lower housing 303. On an internal surface of the discharge sleeve 314 is formed a flow passage 315 that provides communication between the discharge bores 306*a*, 306*b* and the discharge nozzle 313. On surfaces of the lower housing 303 and the piston 302 which undergo the relative movement, are formed flow grooves 316*b* and 317*b* which allow alternate communication between the pump chamber 304 and the suction bore 305, and between the pump chamber 304 and the discharge bores 306*a*, 306*b*, with relative rotational motion of the lower housing and the piston. These flow grooves play roles of a suction valve and a discharge valve of a conventional pump. Reference numeral 318 denotes a displacement sensor and numeral 319 denotes a rotating disk fixed to the piston 302. A position of the piston 302 in the axial direction is detected by the displacement sensor 318 and the rotating disk 319.

It is thought that, among the requests of dispensers mentioned at the beginning herein, (i) increase in accuracy in an amount of application, (ii) reduction in discharging time, and (iii) minimization in an amount of application during one operation can be achieved by the above-mentioned dispenser shown in FIG. 24, because this dispenser is a positive displacement pump composed of a combination of a reciprocating piston and cylinder.

It is, however, difficult for the dispenser to meet the remainder of the requests, i.e., (iv) diameter reduction in and miniaturization of a dispenser body and (v) equipment with multi-nozzles.

In the above-mentioned dispenser shown in FIG. 24, the piezoelectric actuator is used for linear motion and the motor is used for rotational motion.

Besides, power for conversion of electric energy into mechanical energy is required to be applied to an electrode of the rotating piezoelectric element via a conductive brush (a coupling joint).

The above arrangement also requires a bearing and the displacement sensor to be provided in an area surrounding a rotational axis, and thus has a limit with regard to accommodating the requests of diameter reduction of a dispenser body, and equipment with multi-nozzles.

The present invention has been contrived, taking notice of the fact that a positive displacement pump, for example, can be constituted by a combination of two independent linear-motion devices in consideration of phases of motion of these devices. An object of the present invention is to provide a fluid discharge apparatus and method which can apply, for example, a minute amount of powder and granular material, having an extremely high viscosity, at a super high speed and with high accuracy, and can realize substantial diameter reduction in and miniaturization of a dispenser body and simplification of arrangement.

SUMMARY OF THE INVENTION

In accomplishing these and other aspects, according to an aspect of the present invention, there is provided a fluid discharge apparatus that comprises: a first actuator for relatively moving a piston and a housing; a cylinder which accommodates at least a part of the piston and has a space extending therethrough in an axial direction thereof; a second actuator for relatively moving the cylinder and the housing; a pump chamber defined by the piston, the cylinder, and the housing; and a fluid suction opening and a fluid discharge opening which provide communication between the pump chamber and an exterior thereof That is, according to a first aspect of the present invention, there is provided a fluid discharge apparatus comprising:

- a first actuator for relatively moving a piston and a housing;
- a cylinder which accommodates at least a part of the piston and has a space extending therethrough in an axial direction thereof; and
- a second actuator for relatively moving the cylinder and the housing relatively, wherein a pump chamber is defined by the piston, the cylinder, and the housing, and a fluid suction opening and a fluid discharge opening are provided for communication between the pump chamber and an exterior thereof.

According to a second aspect of the present invention, there is provided a fluid discharge apparatus as defined in the first aspect, wherein the first actuator is installed on a fixing section and moves in an axial direction, and the second actuator is installed on an opposite surface of the fixing section and moves in the same axial direction as the first actuator moves.

According to a third aspect of the present invention, there is provided a fluid discharge apparatus as defined in the first aspect, wherein a side of the piston facing the pump chamber has an open end, and a discharge opening is formed on a surface which undergoes relative movement between an end surface of the piston facing the pump chamber and a surface facing the end surface.

According to a fourth aspect of the present invention, there is provided a fluid discharge apparatus as defined in the first aspect, wherein the pump chamber has a capacity that changes with relative movement between the piston and the housing.

According to a fifth aspect of the present invention, there is provided a fluid discharge apparatus as defined in the first aspect, wherein the cylinder and the housing are configured so that a flow passage resistance of fluid traveling between the pump chamber and an exterior thereof changes with relative movement between the cylinder and the housing.

According to a sixth aspect of the present invention, there is provided a fluid discharge apparatus as defined in the first aspect, wherein an end section of the piston facing the pump chamber, and an internal surface section of the cylinder accommodating the end section of the piston, have reduced diameters and are attachable and detachable.

According to a seventh aspect of the present invention, there is provided a fluid discharge apparatus as defined in the first aspect, wherein the first actuator and/or the second actuator are actuators of an electro-magneto-strictive type.

According to an eighth aspect of the present invention, there is provided a fluid discharge apparatus as defined in the seventh aspect, wherein the actuator of electro-magneto-strictive type comprises a piezoelectric element or a giant magnetostrictive element.

According to a ninth aspect of the present invention, there is provided a fluid discharge apparatus as defined in the eighth aspect, wherein an element of an electro-magneto-strictive type, and a control circuit for the element, have both functions of an actuator and of a displacement sensor.

According to a tenth aspect of the present invention, there is provided a fluid discharge apparatus as defined in the first aspect, wherein relative axial positions of the piston and of the housing are controlled on a basis of output from a displacement sensor for detecting the relative axial positions.

According to an eleventh aspect of the present invention, there is provided a fluid discharge apparatus as defined in the first aspect, wherein a displacement sensor comprising a hollow rotor for position detection and a stator for position detection, is used for detecting relative axial positions of the cylinder and of the housing.

According to a twelfth aspect of the present invention, there is provided a fluid discharge apparatus as defined in the eleventh aspect, wherein the displacement sensor is of a differential transformer type.

According to a thirteenth aspect of the present invention, there is provided a fluid discharge apparatus as defined in the first aspect, wherein an axial length of the first actuator is greater than an axial length of the second actuator.

According to a fourteenth aspect of the present invention, there is provided a fluid discharge apparatus as defined in the thirteenth aspect, wherein the first actuator comprises a plurality of actuators arranged along the axial direction.

According to a fifteenth aspect of the present invention, there is provided a fluid discharge apparatus as defined in the first aspect, having a hybrid actuator structure in which a giant magnetostrictive element is employed for any one of the first actuator and the second actuator, and a piezoelectric element is employed for the other of the first actuator and the second actuator.

According to a sixteenth aspect of the present invention, there is provided a fluid discharge apparatus as defined in the first aspect, wherein a linear motor or linear motors are employed for any one or both of the first actuator and the second actuator.

According to a seventeenth aspect of the present invention, there is provided a fluid discharge apparatus as defined in the first aspect, having a linear motor comprising a rod in which radially magnetized cylindrical or solid permanent magnets are laminated, and an electromagnetic coil which surrounds an outer circumference of the rod.

According to an eighteenth aspect of the present invention, there is provided a fluid discharge apparatus as defined in the first aspect, wherein the piston has a shape of a thin plate which is rectangular in cross section.

According to a nineteenth aspect of the present invention, there is provided a fluid discharge apparatus as defined in the first aspect, wherein the first actuator and/or the second actuator are laminated piezoelectric elements each having a rectangular cross section.

According to a twentieth aspect of the present invention, there is provided a fluid discharge system comprising: an enclosure section which accommodates a plurality of fluid discharge apparatus as defined in the first aspect; and a fluid feeder for feeding the enclosure section with fluid.

According to a twenty-first aspect of the present invention, there is provided a fluid discharge system as defined in the twentieth aspect, wherein the enclosure section is configured so that a common fluid feeding passage communicates with a plurality of pump chambers of the plurality of fluid discharge apparatus.

According to a twenty-second aspect of the present invention, there is provided a fluid discharge system as defined in the twentieth aspect, wherein giant magnetostrictive elements, from which permanent magnets are omitted, are employed for the first actuator and/or the second actuator, and a common cooling passage for cooling magnetic field coils is formed in the enclosure section.

According to a twenty-third aspect of the present invention, there is provided a fluid discharge apparatus as defined in the first aspect, wherein at least one of the first actuator and the second actuator comprises a thin-film piezo element.

According to a twenty-fourth aspect of the present invention, there is provided a fluid discharge apparatus wherein at least one of a first actuator and a second actuator has a function of traveling, or expanding and contracting, with aid of an exterior, electromagnetic and non-contact power supplying device.

According to a twenty-fifth aspect of the present invention, there is provided a fluid discharge apparatus as defined in the first aspect, comprising a third actuator for producing relative rotation between the cylinder and the housing, and a pump device for feeding fluid forcefully to a discharge side which is formed on a surface that undergoes relative movement between the cylinder and the housing.

According to a twenty-sixth aspect of the present invention, there is provided a fluid discharge apparatus as defined in the twentififth aspect, wherein the pump device is a thread groove pump.

According to a twenty-seventh aspect of the present invention, there is provided a fluid discharge apparatus as defined in the twentififth aspect, wherein the first actuator is a giant magnetostrictive element.

According to a twenty-eighth aspect of the present invention, there is provided a fluid discharge apparatus as defined in the first aspect, wherein the cylinder and the piston are driven during generally opposite phases.

According to a twenty-ninth aspect of the present invention, there is provided a fluid discharge apparatus as defined in the first aspect, wherein both end portions of one actuator, that expands and contracts axially, are supported by springs, and output of one end of this actuator is used as the first actuator and output of the other end of this actuator is used as the second actuator.

According to a thirtieth aspect of the present invention, there is provided a fluid discharge apparatus as defined in the first aspect, wherein a high-pressure developing source for fluid is provided on an upstream side of the fluid discharge apparatus, and the cylinder and the piston in the fluid discharge apparatus as a fluid control valve are driven during generally opposite phases so as to release or shut off the fluid.

According to a thirty-first aspect of the present invention, there is provided a fluid discharge method comprising:

producing by a first and a second actuator relative movement between a piston and a housing and between a cylinder and the housing, respectively, to open a pump chamber defined by the piston, the cylinder, and the housing, thereby sucking fluid into the pump chamber;

thereafter blocking the pump chamber and a passage on a suction side by driving the second actuator; and thereafter compressing the fluid in the pump chamber by driving the first actuator and the fluid, and thereby discharging the fluid.

According to a thirty-second aspect of the present invention, there is provided a fluid discharge method as defined in the thirtifirst aspect, wherein in producing by the first and the second actuators the relative movement, the first actuator moves in an axial direction and the second actuator moves in the same axial direction as the first actuator moves.

According to a thirty-third aspect of the present invention, there is provided a fluid discharge method as defined in the thirty-first aspect, wherein in producing by the first and the second actuators the relative movement, a capacity of the pump chamber is changed with the relative movement between the piston and the housing.

According to a thirty-fourth aspect of the present invention, there is provided a fluid discharge method as defined in the thirty-first aspect, wherein in producing by the first and the second actuators the relative movement, relative rotation between the cylinder and the housing is produced to feed the fluid forcefully to a discharge side formed on a surface that undergoes relative movement between the cylinder and the housing.

According to a thirty-fifth aspect of the present invention, there is provided a fluid discharge method as defined in the thirty-first aspect, wherein the relative movement is produced by the first and the second actuators by axially expanding and contracting both end portions of one actuator supported by springs so as to use as the first actuator output of one end of this actuator, and use as the second actuator output of the other end of this actuator.

According to a thirty-sixth aspect of the present invention, there is provided a fluid discharge method as defined in the thirty-first aspect, wherein the cylinder and the piston as a fluid control valve are driven during generally opposite phases so as to cancel a change in capacity of the pump chamber to release or shut off the fluid.

According to a thirty-seventh aspect of the present invention, there is provided a fluid discharge method as defined in the thirty-first aspect, wherein in producing by the first and the second actuators the relative movement between the piston and the housing and between the cylinder and the housing, respectively, fluid that is red fluorescent material is sucked into the pump chamber;

after blocking the pump chamber and a passage on a suction side by driving the second actuator, in compressing the fluid in the pump chamber by driving the first actuator and the fluid, the fluid is lineally discharged to apply the fluid onto a panel of a CRT;

then, in producing again by the first and the second actuators the relative movement between the piston and the housing and between the cylinder and the housing, respectively, fluid that is green fluorescent material is sucked into the pump chamber;

after blocking the pump chamber and a passage on a suction side by driving the second actuator, in compressing the fluid in the pump chamber by driving the first actuator and the fluid, the fluid is lineally discharged to apply the fluid onto the panel of the CRT;

then, in producing again by the first and the second actuators the relative movement between the piston and the housing and between the cylinder and the housing, respectively, fluid that is blue fluorescent material is sucked into the pump chamber; and after blocking the pump chamber and a passage on a suction side by driving the second actuator, in compressing the fluid in the pump chamber by driving the first actuator and the fluid, the fluid is lineally discharged to apply the fluid onto the panel of the CRT.

According to a thirty-eighth aspect of the present invention, there is provided a fluid discharge method as defined in the thirty-first aspect, wherein the fluid is fluorescent material or electrode material.

According to a thirty-ninth aspect of the present invention, there is provided a fluid discharge method as defined in the thirty-first aspect, wherein the fluid is fluorescent material in a case where the fluid is discharged onto a CRT.

According to a fortieth aspect of the present invention, there is provided a fluid discharge method as defined in the thirty-first aspect, wherein the fluid is electrode material in a case where the fluid is discharged onto a PDP.

According to a forty-first aspect of the present invention, there is provided a fluid discharge apparatus as defined in the first aspect, wherein the fluid is fluorescent material or electrode material.

According to a forty-second aspect of the present invention, there is provided a fluid discharge apparatus as defined in the first aspect, wherein the fluid is fluorescent material in a case where the fluid is discharged onto a CRT.

According to a forty-third aspect of the present invention, there is provided a fluid discharge apparatus as defined in the first aspect, wherein the fluid is electrode material in a case where the fluid is discharged onto a PDP.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
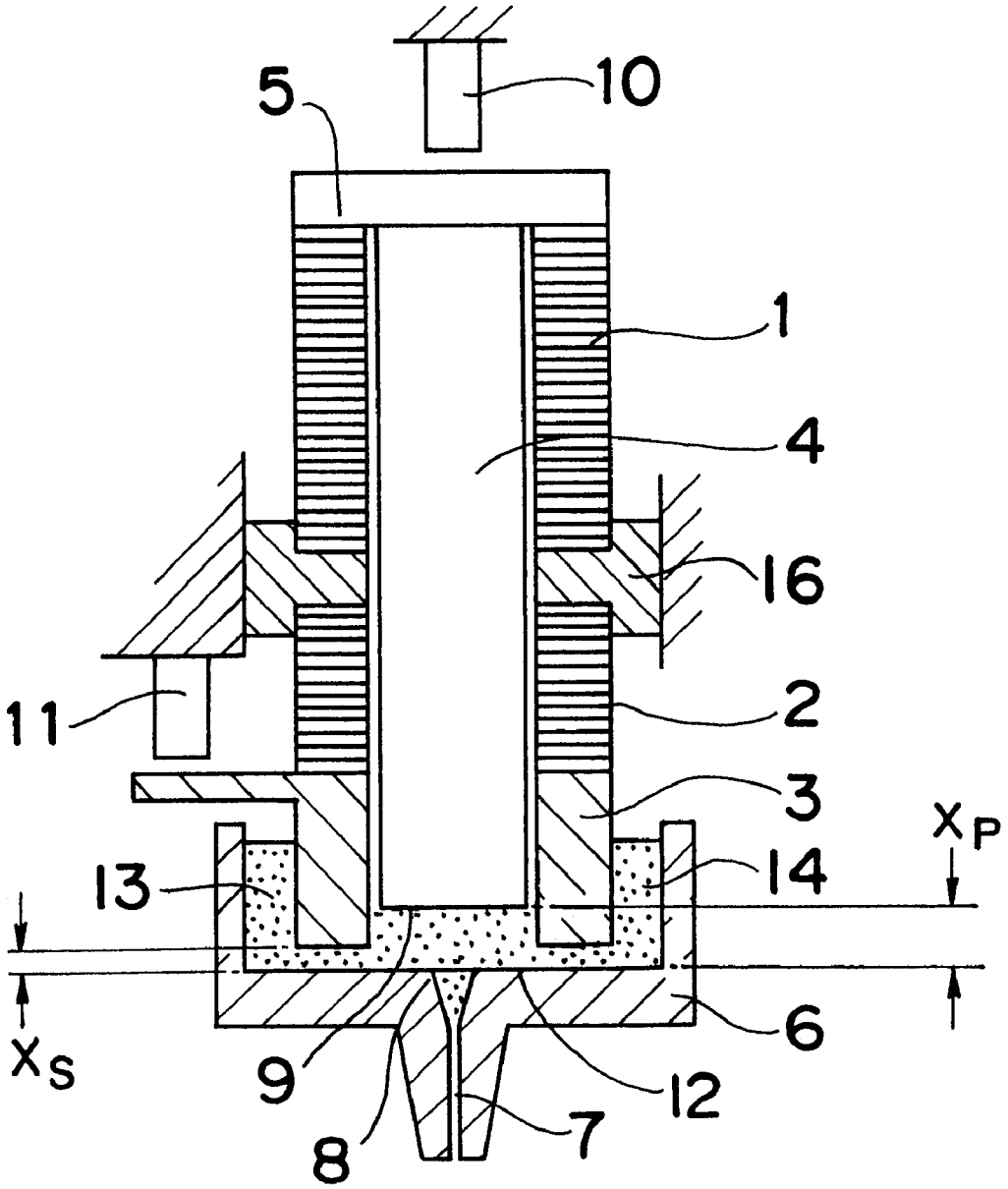
FIG. 1 is a model diagram illustrating principles of the present invention.

Before the description of the present invention proceeds, it is to be noted that like parts are designated by like reference numerals throughout the accompanying drawings. (Description of Principles of the Present Invention)

Prior to a detailed description of a first embodiment of the present invention, principles of driving in an adaptation of the present invention to a positive displacement pump will be described with reference to FIGS. 1 to 3.

Reference numeral 1 denotes an upper actuator (one example of a first actuator), numeral 2 denotes a lower actuator (one example of a second actuator), numeral 3 denotes a movable sleeve (one example of a cylinder) fixed to a free end side of the lower actuator 2, and numeral 4 denotes a piston fixed to a free end side 5 of the upper actuator 1. Numeral 16 denotes a section to which the actuators 1 and 2 are fixed.

The piston 4 is housed so as to pierce center regions of the upper and lower actuators 1 and 2 and so as to be movable in an axial direction. Numeral 6 denotes a housing provided on a fixed side in an area surrounding the movable sleeve, numeral 7 denotes a discharge nozzle formed in a center region of the housing, and numeral 8 denotes an opening of the discharge nozzle formed on a surface facing an end surface 9 of the piston 4. Numeral 10 denotes a displacement sensor A provided on a top end portion of the piston 4, and the sensor detects an absolute position Xp of the piston 4 with respect to the fixed side. Numeral 11 denotes a displacement sensor B that detects an absolute position Xs of the movable sleeve 3. Numeral 12 denotes a pump chamber defined by the piston 4, the movable sleeve 3, and the housing 6. Numeral 14 denotes a storing chamber for fluid 13.

The upper and lower actuators 1 and 2 are driven independently by driving sources (not shown) provided exteriorly, on the basis of output from the displacement sensors 10 and 11.

Hereinbelow, an example of suction and discharge strokes of the pump will be described with reference to FIGS. 2A–2C.

1. Suction Stroke (FIGS. 2A through 2C)

Figure 2C:
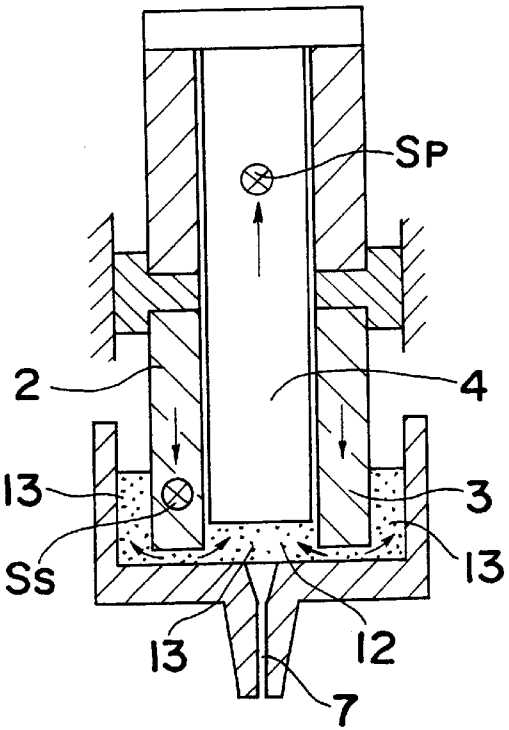
FIGS. 2A, 2B, 2C, 2D, 2E, and 2F are model diagrams illustrating suction and discharge strokes in a first embodiment of the present invention.
Figure 2B:
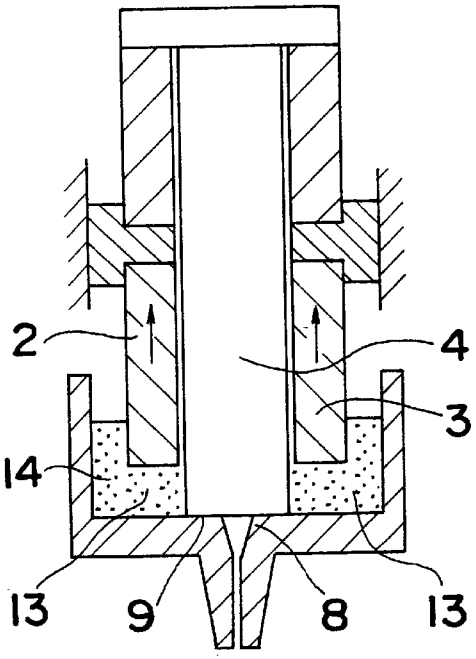
Figure 2A:
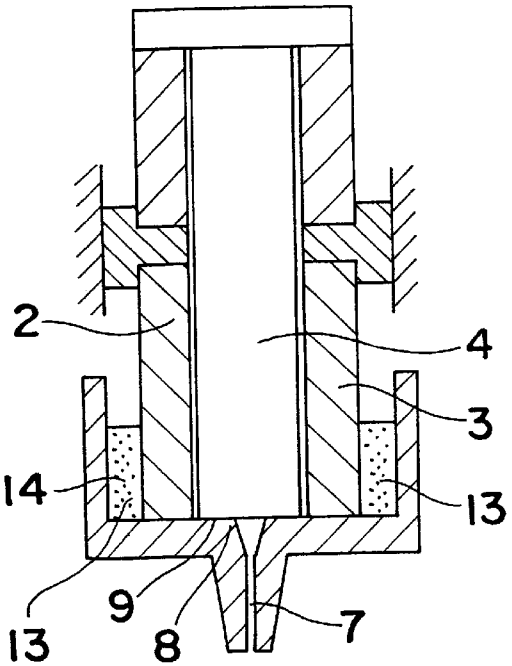
Figure 3:
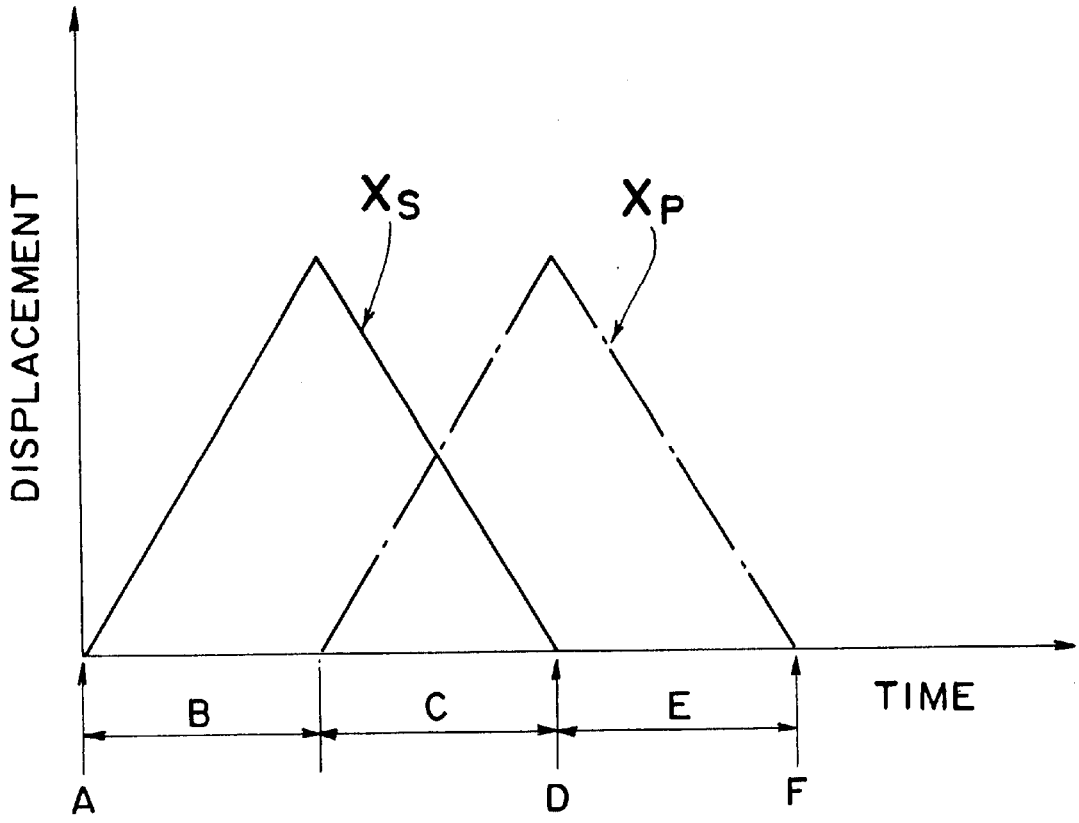
FIG. 3 is a graph illustrating displacement of a piston and of a movable sleeve.

(1) Situation of FIG. 2A

FIG. 2A illustrates a situation in which both the piston 4 and the movable sleeve 3 remains still. The piston 4 has descended to its lowest position so that its end surface 9 covers the opening 8 of the discharge nozzle 7. A gap between the end surface 9 of the piston 4 and a surface facing the end surface is narrow enough to restrain the fluid 13 from flowing out into the discharge nozzle 7. The movable sleeve 3 has similarly descended to its lowest position as the lower actuator 2 has extended.

(2) Situation of FIG. 2B

In FIG. 2B, contraction of the lower actuator 2 as shown by arrows causes the movable sleeve 3 to ascend while the piston 4 remains still. In this stage, the piston 4 is still in its lowest position and has been sealing the opening 8 of the discharge nozzle 7.

(3) Situation of FIG. 2C

Having ascended to a position in the situation of FIG. 2B, the movable sleeve 3, suddenly changes direction and starts to descend. In this stage, the piston 4 starts to ascend.

Ascent of the piston 4 creates a new space in the pump chamber 12, while descent of the movable sleeve 3 displaces the fluid 13 into the pump chamber 12 and into the fluid storing chamber 14 as shown by arrows in the drawing. An ascending speed Sp of the piston 4 and a descending speed Ss of the movable sleeve 3 are established according to cross-sectional areas of the piston and the movable sleeve.

For example, the speeds Sp and Ss are established so that the amount of change in the total volume (V=Vp+Vs) is determined with lapse of time becoming zero, wherein Vs is a volume displaced by descent of the movable sleeve 3 and Vp is a volume of space created newly by ascent of the piston 4.

Where the amount of change in the total volume V is determined when the lapse of time is small, the absolute value of pressure in the pump chamber 12 can be held within a given range so that a large difference in pressure from a discharge side (atmospheric pressure) may not occur. As a result, inflow and outflow of fluid between the pump chamber 12 and the discharge side through the discharge nozzle 7 can be restricted within an allowable range during a suction stroke in FIG. 2C.

Upon arrival at the lowest position of the end surface of the movable sleeve 3, upon the sleeve having descended, the piston 4 reaches a top dead center. The suction stroke is completed at this point.

The above suction stroke is summarized as follows. In the situations of FIGS. 2A and 2B, the outflow of the fluid 13 from the fluid storing chamber 14 to the side of the discharge nozzle 7 is prevented, because the opening 8 of the discharge nozzle 7 is being covered and sealed with the end surface 9 of the piston.

In the situation of FIG. 2C, pressure in the pump chamber 12 tends to be negative, for example, provided the ascending speed Sp of the piston 4 and the descending speed Ss of the movable sleeve 3 are established so that the amount of change in the total volume (V=Vp+Vs) is determined when the lapse of time becomes a small minus. As a result, the outflow of the fluid 13 to the side of the discharge nozzle 7 can be completely prevented.

2. Discharge Stroke (FIGS. 2D to 2E)

Figure 2F:
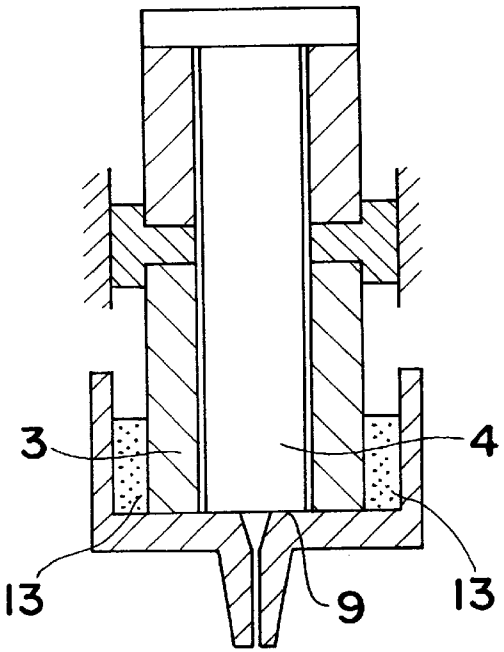
Figure 2E:
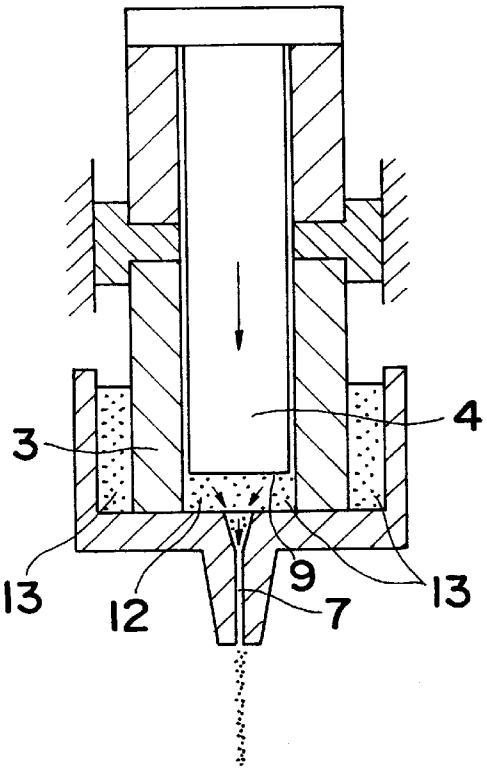
Figure 2D:
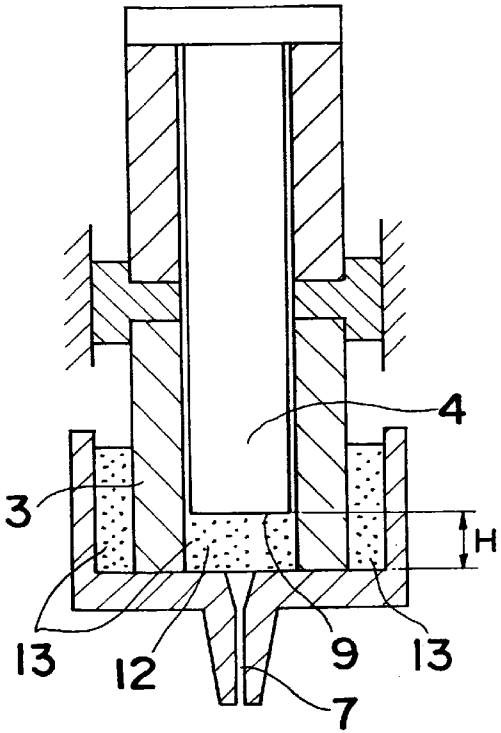

(4) Situation of FIG. 2D

FIG. 2D illustrates a situation at an instant following commencement of the discharge stroke (at an instant of completion of the suction stroke). At this point, the end surface 9 of the piston 4 is in a position having a height H (Xp=H). The height has been predetermined on the basis of a target amount of discharge.

At the instant of the commencement of the discharge stroke, the end surface of the movable sleeve 3 and a surface facing this end surface are in absolute contact with each other or have a gap that is narrow enough, so that the pump chamber 12 is in a closed space isolated from an exterior.

(5) Situation of FIG. 2E

Then, lowering the piston 4 as shown by arrows in FIG. 2E causes pressure of the fluid in the pump chamber 12 to increase, and the fluid is thereby discharged through the discharge nozzle 7.

The degree of increase in the pressure of the fluid is determined by a size and shape of the discharge nozzle 7, viscosity of the fluid, compressibility (modulus of elasticity of volume) of the fluid, speed of the piston 4, and the like.

A total discharge amount of the pump is, however, hardly influenced by those parameters and is determined chiefly by a travel of the piston 4 alone, because the pump functions as a complete positive displacement pump during the discharge stroke.

(6) Situation of FIG. 2F

On arrival at a bottom dead center of the end surface 9 of the piston 4 having descended, the fluid 13 in the pump chamber 12 has been evacuated to an exterior and the discharge stroke is completed (from then on, the operation returns to the above situation of FIG. 2A).

Where the fluid discharge apparatus of the embodiment of the present invention is used as a pump for a minute flow rate, employment of electro-magneto-strictive actuators, such as piezoelectric elements or giant magnetostrictive elements, as the upper and lower actuators 1 and 2, causes a preferable effect of high responsibility not less than a few megahertz.

For discharging highly viscous fluid at a high speed, the upper and lower actuators 1, 2 are required to have a great thrust resisting a high fluid pressure. In this case, electro-magneto-strictive actuators capable of easily outputting a force of hundreds to thousands of newtons are advantageous.

Besides, to perform feedback control with position detection would ensure a high positioning accuracy not more than 1 $\mu$m. Herein, piezoelectric elements and giant magneto-strictive elements are referred to as electro-magneto-strictive elements.

In a pump working with a minute flow rate as will be shown in preferred embodiments, quantity of displacement of the piston in the axial direction may be minute, i.e., in a range from a few micrometers to tens of micrometers. With this advantage of a minute displacement, a limitation on stroke with regard to piezoelectric elements and giant magnetostrictive elements offers no problem.

Where piezoelectric elements or giant magnetostrictive elements are employed as the upper and lower actuators 1, 2, stroke control over the piston 4 and the movable sleeve 3 can be performed even with open-loop control without a displacement sensor, because an input voltage (or an input current in the case of giant magnetostrictive element) to the elements and the displacement of the elements are directly proportional. Nevertheless, to perform feedback control with such a position detecting device as used in this embodiment ensures flow rate control with higher accuracy.

A displacement Xp of the piston 4 in FIG. 1 (accuracy in the height H in FIG. 2D) directly exerts an influence upon accuracy in a total discharge amount of the dispenser, while a small error in positional accuracy of the movable sleeve 3 is allowable in many instances because a main role of the movable sleeve 3 is to seal off the pump chamber 12 from the exterior. Accordingly, feedback control with position detection with use of a displacement sensor may be applied only to the piston 4, while open-loop control without use of a displacement sensor may be applied to the movable sleeve 3. In this case, timing of the movement of the movable sleeve 3 may be started based on output from the displacement sensor for the piston 4.

Where the present invention is adapted to a dispenser and a positive displacement pump, as the embodiment thereof is hereby configured, some functions which cannot be fulfilled by conventional air pulse type and thread groove type pumps can be achieved. For example, a small amount of ascent of the piston in a situation immediately following completion of discharge, as shown in FIG. 2F, would generate a negative pressure in the pump chamber 12 and would thereby prevent fluid dripping (not shown).

Generation of an impactive load by an electro-magneto-strictive actuator having a high response could cause discharged fluid to fly with a large momentum, because the dispenser is tightly sealed except for a passage on a side of the discharge nozzle (not shown).

In this embodiment, the housing is fixed, and the actuators are arranged so as to produce relative motion between the piston and the housing, and between the cylinder and the housing.

For this arrangement, an arrangement may be substituted in which, for example, the piston is fixed and the housing is driven by the first actuator (not shown).

Otherwise, an arrangement may be substituted in which the movable sleeve (the cylinder) is fixed and the housing is driven by the second actuator (not shown).

One example of suction and discharge strokes in adaptation of the present invention to a dispenser has been described above. FIG. 3 illustrates relationships between displacement of the movable sleeve 3 and of the piston 4, and each step (A to F, that is, FIG. 2A to FIG. 2F) in this example. In FIG. 3, reference character Xp denotes displacement of the piston 4 and reference character Xs denotes displacement of the movable sleeve 3.

Hereinbelow, more specified embodiments of the present invention will be described.

Figure 4:
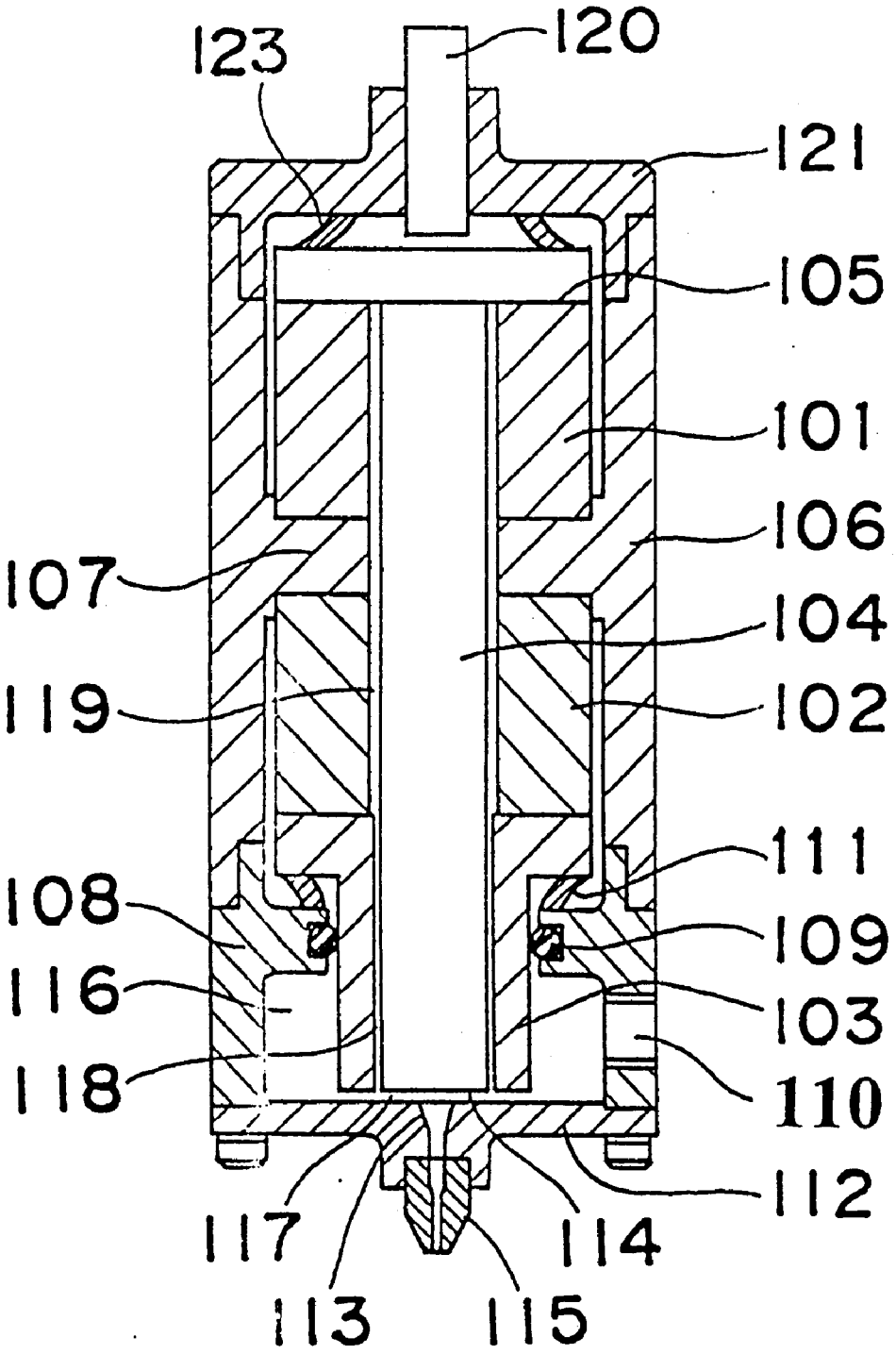
FIG. 4 is a cross-sectional front view illustrating a dispenser of a first embodiment of the present invention.

FIG. 4 illustrates a first embodiment in which the present invention is adapted to a dispenser for surface-mounting of electronic components. Reference numeral 101 denotes an upper actuator (one example of a first actuator) and numeral 102 denotes a lower actuator (one example of a second actuator).

In this embodiment, cylindrical piezoelectric elements which ensure a high positioning accuracy, have a high responsibility, and provide a large developed load are employed as the actuators 101 and 102, for intermittent discharge of a minute amount of highly viscous fluid at a high speed and with a high accuracy.

Reference numeral 103 denotes a movable sleeve (one example of a cylinder) fixed to a free end side of the lower actuator 102, and numeral 104 denotes a piston fixed to a free end side 105 of the upper actuator 101, and the piston corresponds to a direct-acting part of a reciprocating pump (a direct-acting pump).

Numeral 106 denotes an upper housing that accommodates the actuators 101 and 102, and numeral 107 denotes a fixing section for the piezoelectric elements that constitute the actuators 101 and 102.

The piston 104 is accommodated so as to pierce central regions of the upper and lower actuators 101 and 102 and so as to be movable in an axial direction.

Numeral 108 denotes a lower housing provided on a fixed side in an area surrounding the movable sleeve 103 and fastened to the upper housing 106. Numeral 109 denotes a contact seal installed between the movable sleeve 103 and the lower housing 108, and numeral 110 denotes a suction opening.

Numeral 111 denotes a bias spring for applying an axial bias load to the lower actuator (piezoelectric element) 102, and the bias spring 111 is installed between the movable sleeve 103 and the lower housing 108.

Numeral 112 denotes a lower plate fixed to the lower housing 108, and numeral 113 denotes an orifice of a discharge opening formed at a central region of the lower plate 112 and on a surface facing an end surface 114 of the piston 104. Numeral 115 denotes a discharge nozzle fastened to the lower plate 112.

Numeral 116 denotes a fluid storing section utilizing a space defined by the movable sleeve 103 and the lower housing 108, and communicating with an exterior fluid feeder (not shown) through the suction opening 110. Numeral 117 denotes a pump chamber that is a space defined by the movable sleeve 103, the piston 104, and the lower plate 112.

Numeral 118 denotes a non-contact seal section where a clearance between the movable sleeve 103 and the piston 104 is arranged so as to be as small as possible. Numeral 119 denotes a void between the piston 104 and the first and second actuators 101, 102.

Numeral 120 denotes a displacement sensor provided on a top end side of the piston 104 and fixed to an upper plate 121, and the displacement sensor 120 detects an absolute position of the piston 104 with respect to the fixed side.

In the embodiment, a displacement sensor for detecting a position of the movable sleeve 103 in an axial direction is omitted.

Numeral 123 denotes a bias spring for applying an axial bias load to the upper actuator (piezoelectric element) 101, and the spring 123 is installed between the piston 104 and the upper plate 121. The bias springs 111 and 123 continuously exert axial compressive stresses on a electro-magneto-strictive element, and thereby cancel a defect of the electro-magneto-strictive element, i.e., vulnerability to tensile stress in the case that repeated stress is generated.

In the above embodiment, the two independent actuators (linear-motion devices), the displacement sensor, and the discharge nozzle are disposed coaxially in series.

In addition, the positive displacement pump is configured with the pierced central regions of the two linear-motion devices, and with synchronized operation in consideration of phases of motion. As a result, a positive displacement pump having an extremely small diameter and a simple configuration can be obtained as is apparent from the drawing of the configuration of this embodiment.

Figure 5:
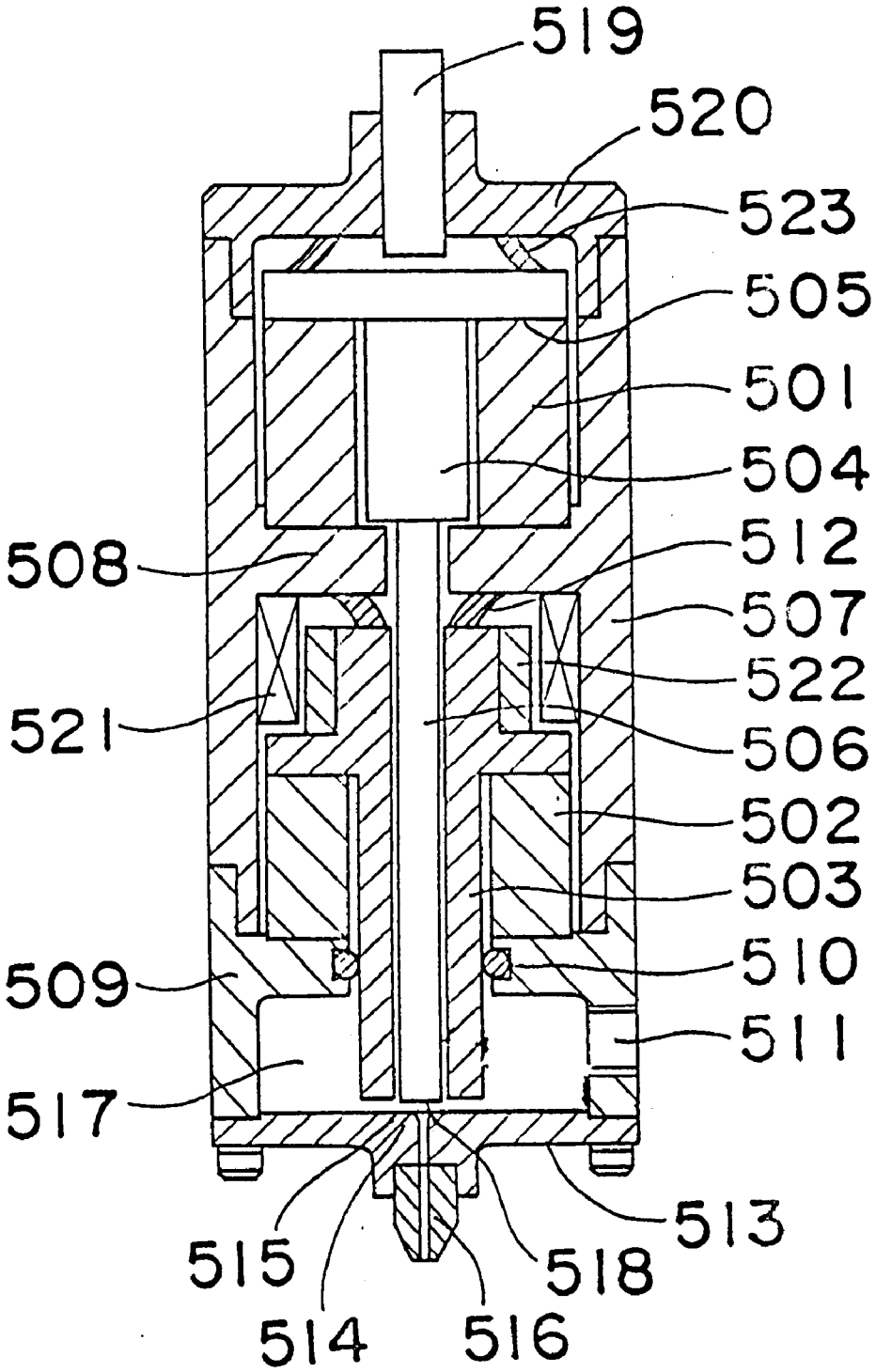
FIG. 5 is a cross-sectional front view illustrating a dispenser of a second embodiment of the present invention.

FIG. 5 illustrates a second embodiment in which a fluid discharge apparatus of the present invention is adapted to a dispenser, and in which a displacement sensor for a movable sleeve is also provided for a further increase in accuracy of discharge flow rate.

Reference numeral 501 denotes an upper actuator, numeral 502 denotes a lower actuator, numeral 503 denotes a movable sleeve fixed to a free end side of the lower actuator 502, numeral 504 denotes a piston fixed to a free end side 505 of the upper actuator 501, and numeral 506 denotes a small-diameter portion of the piston 504.

Numeral 507 denotes an upper cylindrical housing that accommodates the actuators 501 and 502, and numeral 508 denotes a fixing section for piezoelectric elements that constitute the actuators 501 and 502.

Numeral 509 denotes a lower cylindrical housing fastened to the upper housing 507. Numeral 510 denotes a contact seal installed between the movable sleeve 503 and the lower housing 509, and numeral 511 denotes a suction opening.

Numeral 512 denotes a bias spring for applying an axial bias-load to the lower actuator 502, and the spring 512 is installed between the movable sleeve 503 and the upper housing 507.

Numeral 513 denotes a lower plate fixed to the lower housing 509, and numeral 514 denotes an orifice of a discharge opening formed at a central region of the lower plate 513 and on a surface facing an end surface 515 of the small-diameter portion 506 of the piston 504. Numeral 516 denotes a discharge nozzle fastened to the lower plate 513.

Numeral 517 denotes a fluid storing section utilizing a space defined by the movable sleeve 503 and the lower housing 509 and communicating with an exterior fluid feeder (not shown) through the suction opening 511. Numeral 518 denotes a piston chamber that is a space defined by the movable sleeve 503, the small-diameter portion 506 of the piston 504, and the lower plate 513.

Numeral 519 denotes a piston displacement sensor provided on a top end side of the piston 504 and fixed to an upper plate 520, and the sensor 519 detects an absolute position of the piston 504 with respect to a fixed side. Numeral 521 denotes a stator unit of a displacement sensor of a differential transformer type fixed to an inner surface of the upper housing 507, and numeral 522 denotes a rotor unit fixed to an outer surface of the movable sleeve 503.

The differential transformer is of a type used for electric micrometers and detects a position of the movable sleeve 503 in an axial direction.

Numeral 523 denotes a bias spring for applying an axial bias load to the upper actuator (piezoelectric element) 501, and the spring 523 is installed between the piston 504 and the upper plate 520.

In this embodiment, a position of the movable sleeve 503 in an axial direction can be detected with precision by the differential transformer. This arrangement ensures control with a precise adjustment between operation timings of the two actuators 501 and 502, and strict control over displacement and speed of both the actuators 501 and 502. As a result, accuracy in a discharge flow rate can be increased.

Additionally, the dispenser as a whole can be configured so as to ensure small diameters of the cylindrical housings 507 and 509, with use of a displacement sensor composed of the rotor unit 522 and the stator unit 521 for position detection of the movable sleeve 503 as shown in this embodiment.

This embodiment has a configuration in which the two actuators, the two sensors, the piston, and the discharge nozzle are disposed axially and axisymmetrically. For example, outside diameters of giant magnetostrictive elements and piezoelectric elements can be decreased to not greater than several millimeters, as well known.

The present invention therefore provides a microminiature positive displacement dispenser of "pencil size" that is capable of applying highly viscous fluid with precision.

Hereinbelow, a third embodiment in which the present invention is adapted to a dispenser will be described.

The third embodiment shows an example in which not an end surface but a side surface of a movable sleeve is used for sealing a pump chamber with the movable sleeve.

Initially, principles of the present invention will be described with reference to model diagrams of FIGS. 6 and 7.

Reference numeral 601 denotes an upper actuator, numeral 602 denotes a lower actuator, numeral 603 denotes a movable sleeve fixed to a free end side of the lower actuator 602, numeral 604 denotes a piston, numeral 605 denotes a housing, numeral 606 denotes a discharge nozzle, numeral 607 denotes a displacement sensor, numeral 608 denotes a pump chamber defined by the piston, movable sleeve, and housing, numeral 609 denotes a storing chamber for fluid 610, and numeral 611 denotes a small-diameter portion of the housing 605.

Figure 6:
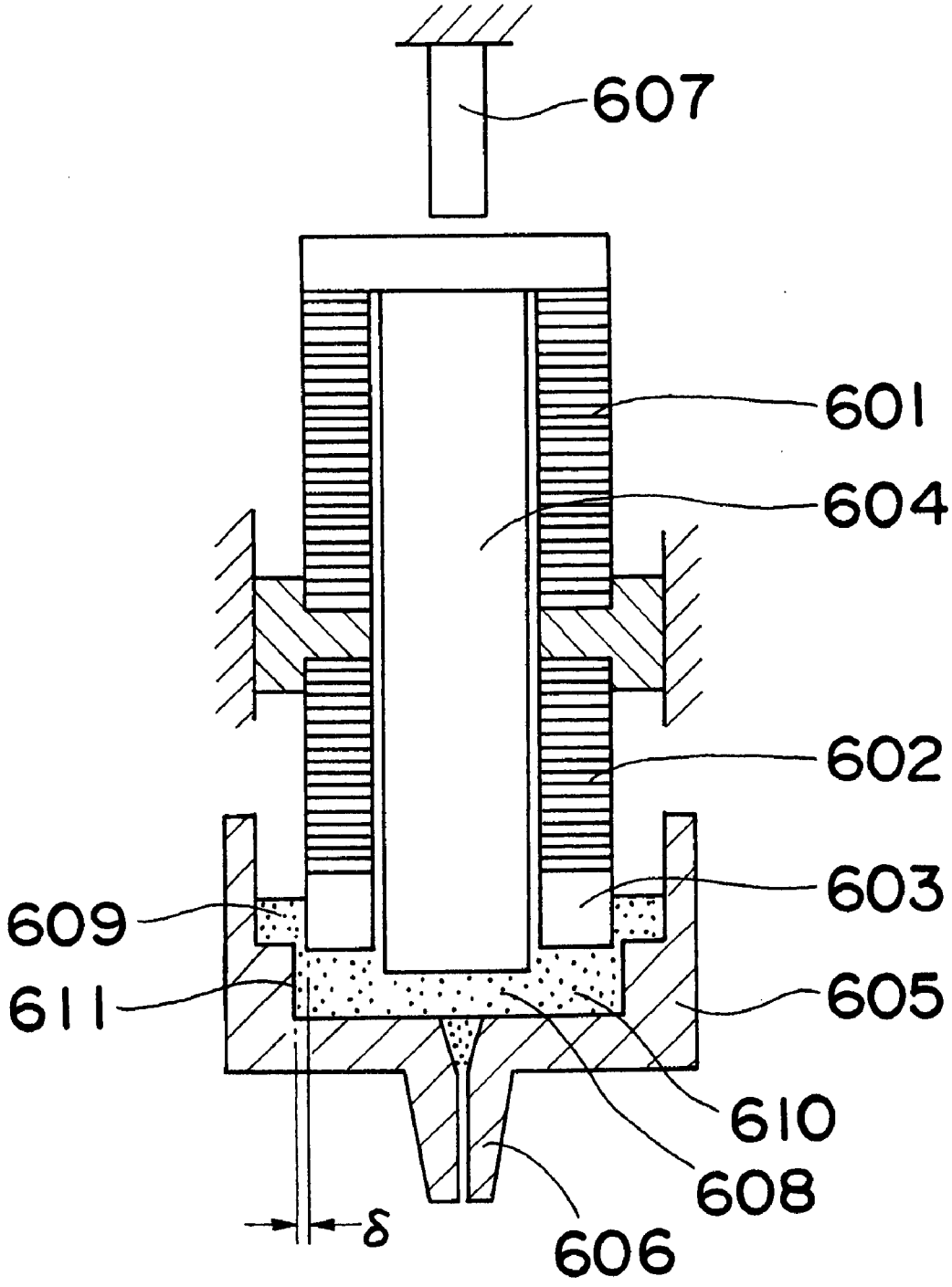
FIG. 6 is a model diagram of a third embodiment of the present invention.

FIG. 6 illustrates a situation in which a narrow gap 6 is maintained between a side surface of the movable sleeve 603 and the small-diameter portion 611 of the housing 605 so that the pump chamber 608 is isolated from an exterior (from the fluid storing chamber 609).

Hereinbelow, a description from a situation just before completion of a suction stroke of the pump to the completion of a discharge stroke will be illustrated with reference to FIGS. 7A–7C.

Figures 7A, 7B, 7C:
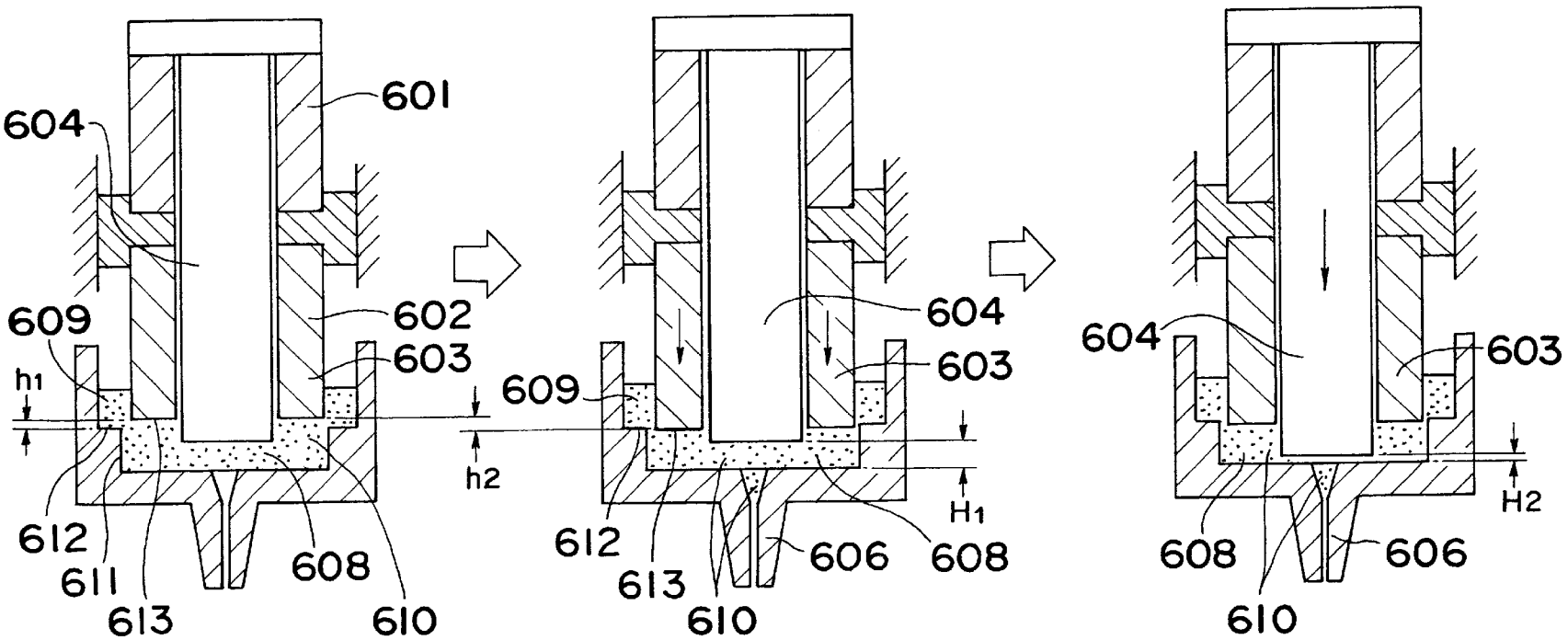
FIGS. 7A, 7B, and 7C are model diagrams illustrating a discharge stroke in the third embodiment of the present invention.

(1) Situation of FIG. 7A

FIG. 7A illustrates a situation just before completion of a suction stroke. In this situation, the pump chamber 608 already has been filled fully with fluid.

The fluid storing chamber 609 and the pump chamber 608 communicate with each other through a clearance (having a size h1) between a top end surface 612 of the small-diameter portion 611 of the housing 605 and a bottom end surface 613 of the movable sleeve 603.

(2) Situation of FIG. 7B

The movable sleeve 603 is lowered by a small amount (a size h2) from the state of FIG. 7A. As a result, the bottom end surface 613 of the movable sleeve 603 moves to a position lower than the top end surface 612 of the small-diameter portion 611 of the housing 605. The gap between the side surface of the movable sleeve 603 and the small-diameter portion 611 has been set small enough, so that a passage for fluid 610 between the fluid storing chamber 609 and the pump chamber 608 is cut off in this stage.

During transportation of compressible fluid, an increase in compression in the pump chamber 608 is small in a majority of cases, because travel of the movable sleeve 603 may be as small as the size h2.

For minimizing compression increase to restrain fluid from leaking out into a discharge side, the piston 604 has only to be raised by an amount corresponding to a volume that is equivalent to or larger than a volume displaced by the movable sleeve 603.

The piston 604 is subsequently lowered from a position having a height H1 while the movable sleeve 603 remains still. The fluid 610 is then discharged into an atmosphere side through the discharge nozzle 606, because the pump chamber 608 has formed a closed space except for a passage on the discharge side.

(3) Situation of FIG. 7C

Upon arrival of the piston 604 at a bottom dead center (having a height H2), the discharge stroke is completed. A stroke (H1–H2) of the piston 604 is determined by a target value of total amount of discharge flow.

Raising the piston 604 by a small amount after completion of the discharge stroke causes pressure in the pump chamber 608 to tend to be negative, and thus the fluid 610 remaining inside the discharge nozzle 606 can be brought back into the pump chamber 608. As a result, any fluid body which adheres to a tip of the discharge nozzle 606 normally with surface tension is eliminated, and thread-forming, fluid dripping, and the like can be prevented (not shown).

During the suction stroke in this embodiment, inflow and outflow of fluid between the pump chamber 608 and the discharge nozzle 606 are apprehended. It is noted, however, that a pressure to be developed in the pump chamber 608 can be set sufficiently large because the pump to which the present invention is adapted is of a positive displacement type. Provided that the pressure to be developed can be set sufficiently large, fluid resistance of the discharge nozzle 606 can be set sufficiently large. That is, a diameter of the discharge nozzle can be set smaller and a length of the nozzle 606 can be set larger.

As a result, leakage or back flow between the pump chamber. 608 and the discharge nozzle 606 during the suction stroke can be restricted within a range that is almost negligible in practice.

Figure 8:
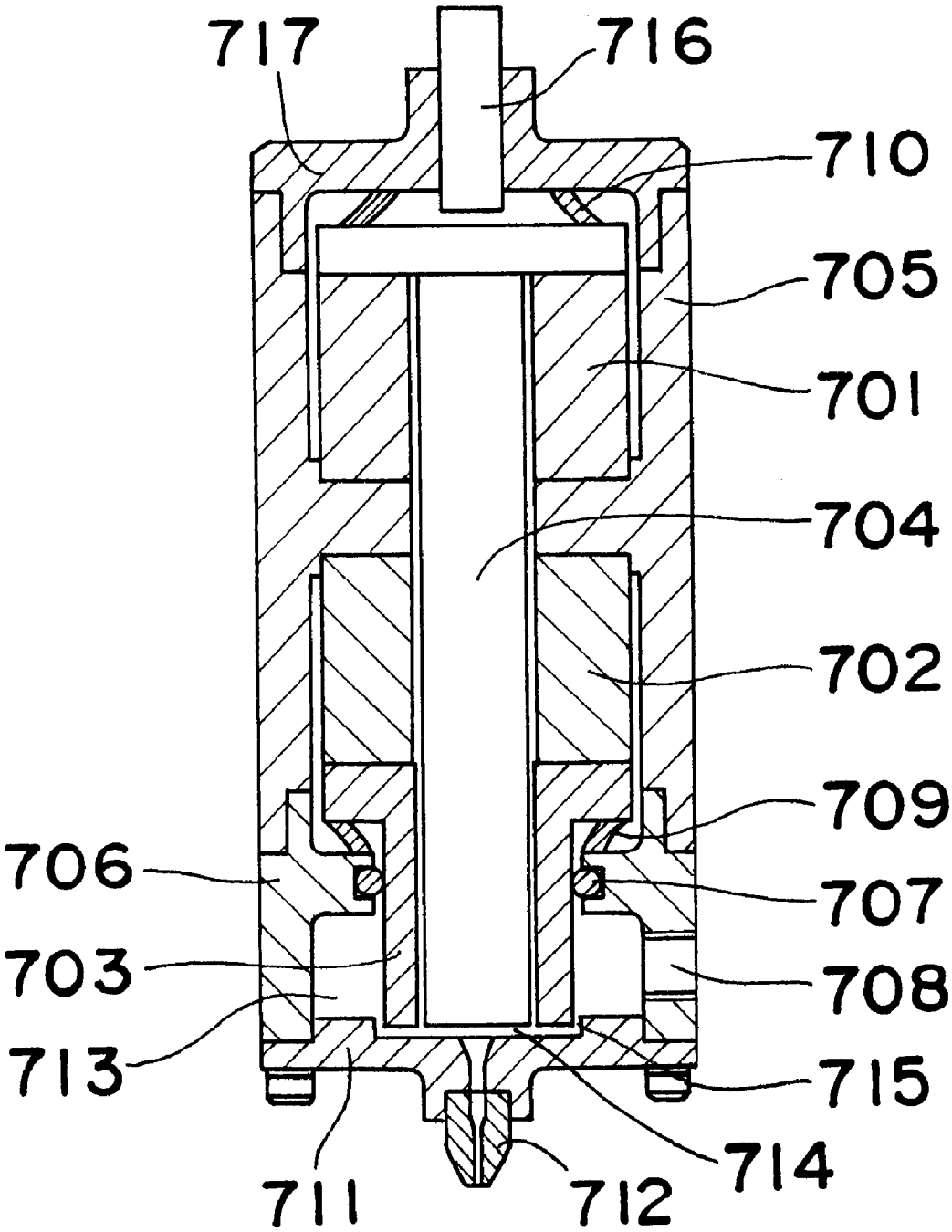
FIG. 8 is a cross-sectional front view illustrating a dispenser of the third embodiment of the present invention.

FIG. 8 illustrates a specific configuration of the third embodiment. Reference numeral 701 denotes an upper actuator, numeral 702 denotes a lower actuator, numeral 703 denotes a movable sleeve, numeral 704 denotes a piston, numeral 705 denotes an upper housing, numeral 706 denotes a lower housing, numeral 707 denotes a contact seal, numeral 708 denotes a suction opening, numerals 709 and 710 denote bias springs, numeral 711 denotes a lower plate, numeral 712 denotes a discharge nozzle, numeral 713 denotes a fluid storing section, numeral 714 denotes a pump chamber, and numeral 715 denotes a non-contact seal section where a clearance between the movable sleeve 703, having descended, and the lower plate 711 is arranged so as to be as small as possible.

Numeral 716 denotes a displacement sensor for detecting a position of the piston 104, and the sensor 716 is installed in an upper plate 717.

In the third embodiment, not an end surface but a side surface (section 715) of the movable sleeve 703 is used for fluid seal of the pump chamber 714 with the movable sleeve 703.

Accordingly, a positioning accuracy of the movable sleeve 703 in an axial direction may be rougher than in the case where an end surface of the moveable sleeve 103 is used. As a result, a displacement sensor for detecting a position of the movable sleeve 703 in an axial direction can be omitted.

Figure 9:
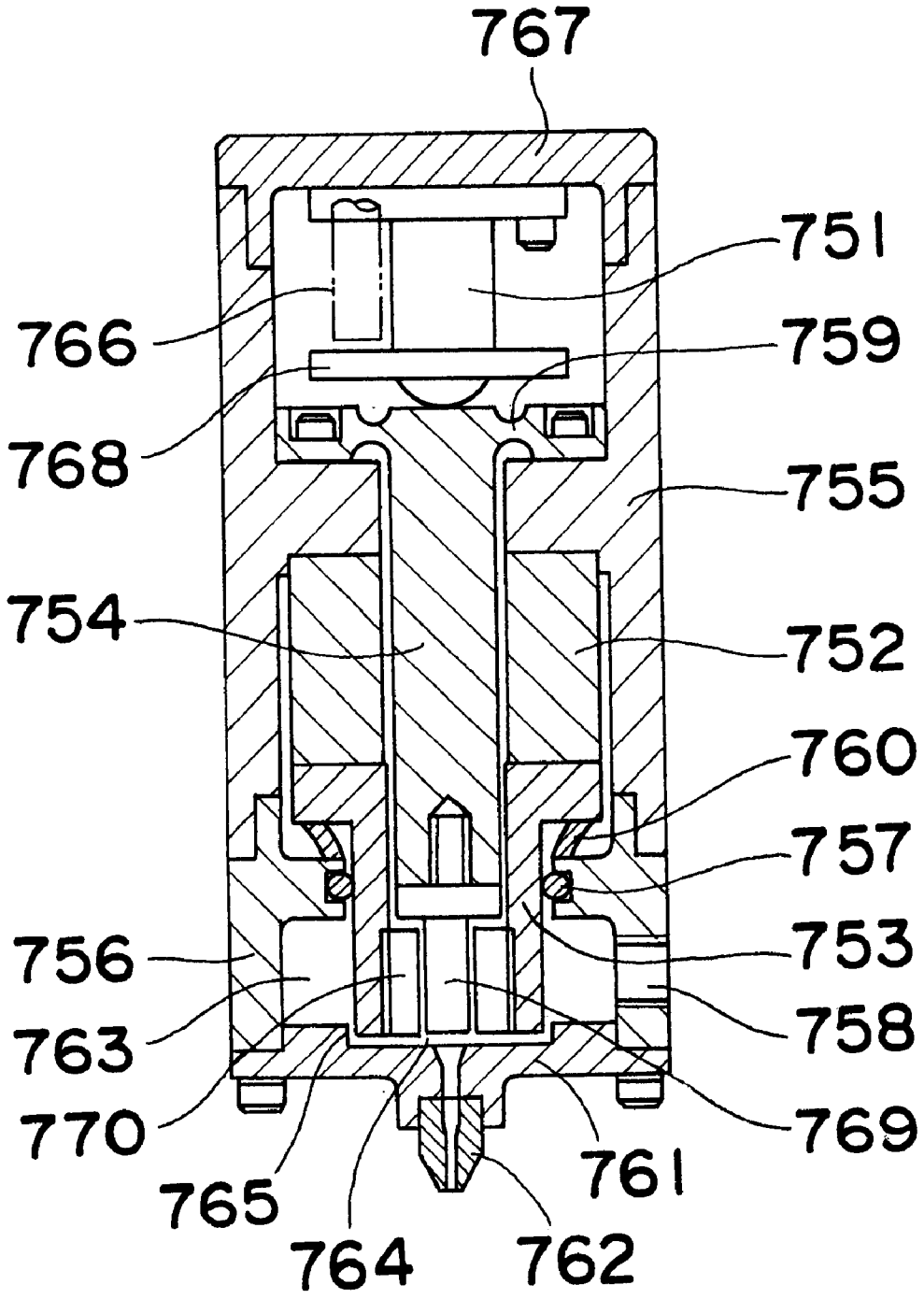
FIG. 9 is a cross-sectional front view illustrating a dispenser of a fourth embodiment of the present invention.

Hereinbelow, a fourth embodiment of the present invention will be described with reference to FIG. 9.

The fourth embodiment shows an example using not a cylindrical, but rather a solid element for a first actuator that drives a piston. In this arrangement, an upper actuator can be mounted and removed as a unit.

Reference numerals 751 and 752 denote upper and lower actuators each composed of a laminated piezoelectric element, numeral 753 denotes a movable sleeve, numeral 754 denotes a piston, numeral 755 denotes an upper housing, numeral 756 denotes a lower housing, numeral 751 denotes a contact seal, numeral 758 denotes a suction opening, numeral 759 denotes an upper bias spring formed of a thinned portion of the piston 754, numeral 760 denotes a lower bias spring, numeral 761 denotes a lower plate, numeral 762 denotes a discharge nozzle, numeral 763 denotes a fluid storing section, numeral 764 denotes a pump chamber, numeral 765 denotes a non-contact seal section, numeral 766 denotes a displacement sensor, and numeral 767 denotes an upper plate.

A fixed side of the upper actuator 751 is attached to the upper plate 767. A movable tip end portion of the upper actuator 751 is provided with a flange 768, and an axial displacement of the piston 754 is detected from a position of a surface of the flange 768.

Numeral 769 denotes a small-diameter portion of the piston 754 that has been screwed into an end surface on a discharge side of the piston 754, and numeral 770 denotes a small-diameter portion of cylinder that is provided in the movable sleeve 753 so as to fit with an outside diameter of the small-diameter portion 769 of the piston 754. In this arrangement, advantage could be effectively taken of a maximal stroke of the piston 754, with selection of the outside diameter of the small-diameter portion 769 of the piston 754 being in conformity with a maximal required discharge amount of the dispenser. The larger the displacement of the piston 754 is, the higher an accuracy in detecting the displacement, i.e., accuracy in a flow rate can be made.

The fourth embodiment exhibits an example using laminated piezoelectric elements for both the actuators; however, giant magnetostrictive elements may be used.

Hereinbelow, a fifth embodiment of the present invention will be described.

The fifth embodiment is intended for achieving a long stroke of a piston and ensures continuous application (drawing) within a limited period of time.

Figure 10:
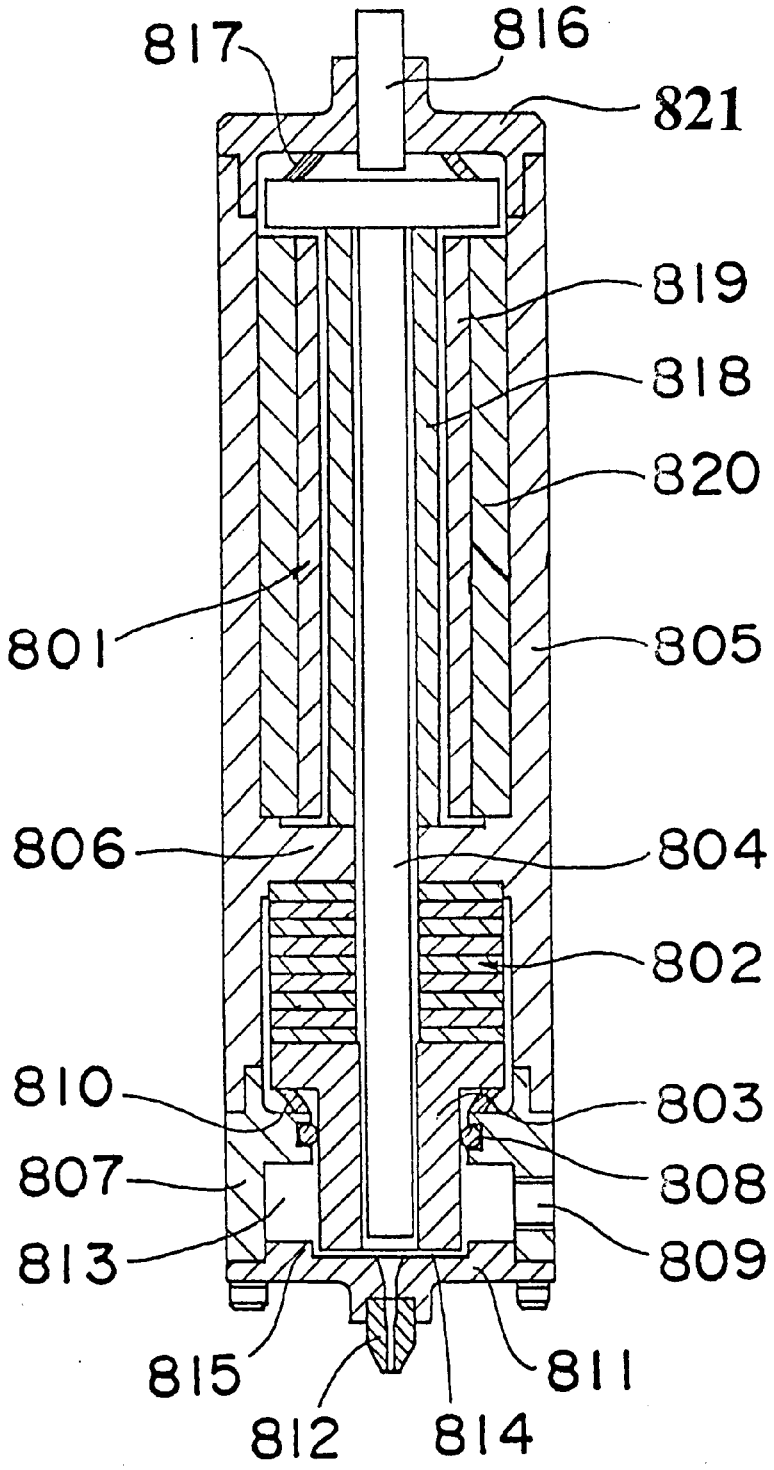
FIG. 10 is a cross-sectional front view illustrating a dispenser of a fifth embodiment of the present invention.

In FIG. 10, reference numeral 801 denotes an upper actuator and numeral 802 denotes a lower actuator.

In order that the upper actuator 801 may have a long stroke, the fifth embodiment employs as the upper actuator 801 a cylindrical giant magnetostrictive element that normally has a stroke approximately twice that of a piezoelectric element having the same length. As the lower actuator 802, a piezoelectric element is employed as in the case of the aforementioned embodiments, because the lower actuator according to specifications of a dispenser of the fifth embodiment may have a small stroke.

That is, the dispenser of the fifth embodiment has a hybrid actuator structure in which a giant magnetostrictive element and a piezoelectric element are combined.

Numeral 803 denotes a movable sleeve fixed to a free end side of the lower actuator 802, numeral 804 denotes a piston, numeral 805 denotes an upper housing, and numeral 806 denotes a fixing section for the upper and lower actuators 801 and 802. The piston 804 is accommodated so as to pierce central regions of the upper and lower actuators 801 and 802, and so as to be movable in an axial direction.

Numeral 807 denotes a lower housing, numeral 808 denotes a contact seal installed between the movable sleeve 803 and the lower housing 807, numeral 809 denotes a suction opening, numeral 810 denotes a bias spring, numeral 811 denotes a lower plate, numeral 812 denotes a discharge nozzle, numeral 813 denotes a fluid storing section, numeral 814 denotes a pump chamber, and numeral 815 denotes a non-contact seal section where a clearance between the movable sleeve 803, having descended, and the lower plate 811 is arranged so as to be as small as possible.

Numeral 816 denotes a displacement sensor for detecting a position of the piston 804. In the fifth embodiment, a displacement sensor for detecting a position of the movable sleeve 803 in an axial direction is omitted. Numeral 817 denotes a bias spring for applying an axial bias load to the upper actuator (the giant magnetostrictive element) 801, and the spring 817 is installed between the piston 804 and upper plate 821. The bias spring 817 continuously exerts an axial compressive stress on the giant magnetostrictive element and thereby cancels a defect of the giant magnetostrictive element, i.e., vulnerability to tensile stress in the case that repeated stress is generated.

Numeral 818 denotes a giant magnetostrictive rod composed of a giant magnetostrictive element. A top portion of the giant magnetostrictive rod 818 is fastened to the piston 804 and a bottom portion of the rod 818 is fastened to the fixing section 806.

Numeral 819 denotes a magnetic field coil for applying a magnetic field in a longitudinal direction of the giant magnetostrictive rod 818. Numeral 820 denotes a permanent magnet for applying a bias magnetic field, and the magnet 820 is accommodated in the upper housing 805. The permanent magnet 820 previously applies a magnetic field to the giant magnetostrictive rod 818 to increase an operating point of the magnetic field. This magnetic bias improves linearity of the giant magnetostrictive element relative to an intensity of the magnetic field. The upper actuator 801 is thus composed of the giant magnetostrictive rod 818, magnetic field coil 819, and permanent magnet 820.

Giant magnetostrictive materials are alloys of rare earth elements and iron. For example, $TbFe_2$, $DyFe_2$, $SmFe_2$, and the like have been known, and such materials have been put to practical use rapidly in recent years.

The arrangement of the fifth embodiment allows the piston 804 to have a sufficiently long stroke and thereby enables not only intermittent application, but also continuous application (drawing), in a limitedly short period of time. In FIG. 10, speed of the piston 804 is controlled on the basis of output from the displacement sensor 816. Keeping a fixed speed of the piston 804 permits lines of constant width to be drawn precisely.

In electro-magneto-strictive elements, it is known that length of stroke of one actuator having a shaft length exceeding a certain value is limited by internal stress. Where a plurality of actuators (giant magnetostrictive elements or piezoelectric elements) are connected in series in an axial direction, therefore, stroke of a piston can be further extended (not shown).

In the case that a displacement sensor of an eddy current type, electrostatic type, or the like has a length measuring limit, provision of a plurality of displacement sensors for detecting relative displacement between actuators, and of a sensor for detecting absolute position of a piston, enables calculation of an absolute position of the piston and thus resolves such a problem (not shown).

In the fifth embodiment, the permanent magnet 820 that applies a bias magnetic field for driving the upper actuator 801 (giant magnetostrictive element) is provided on a side of an outer circumference of the magnetic field coil 819. An outside diameter of the dispenser body can be further reduced providing that the permanent magnet 820 is omitted and a bias magnetic field is applied by passage of a bias current through the magnetic field coil 819.

Without such a permanent magnet for applying a bias magnetic field, heat generation in a giant magnetostrictive element is apprehended. Where a common enclosure accommodating a plurality of dispensers is provided for implementation of a multi-nozzle dispenser, a common cooling passage for cooling magnetic field coils of giant magnetostrictive elements can be formed (not shown).

Figure 11:
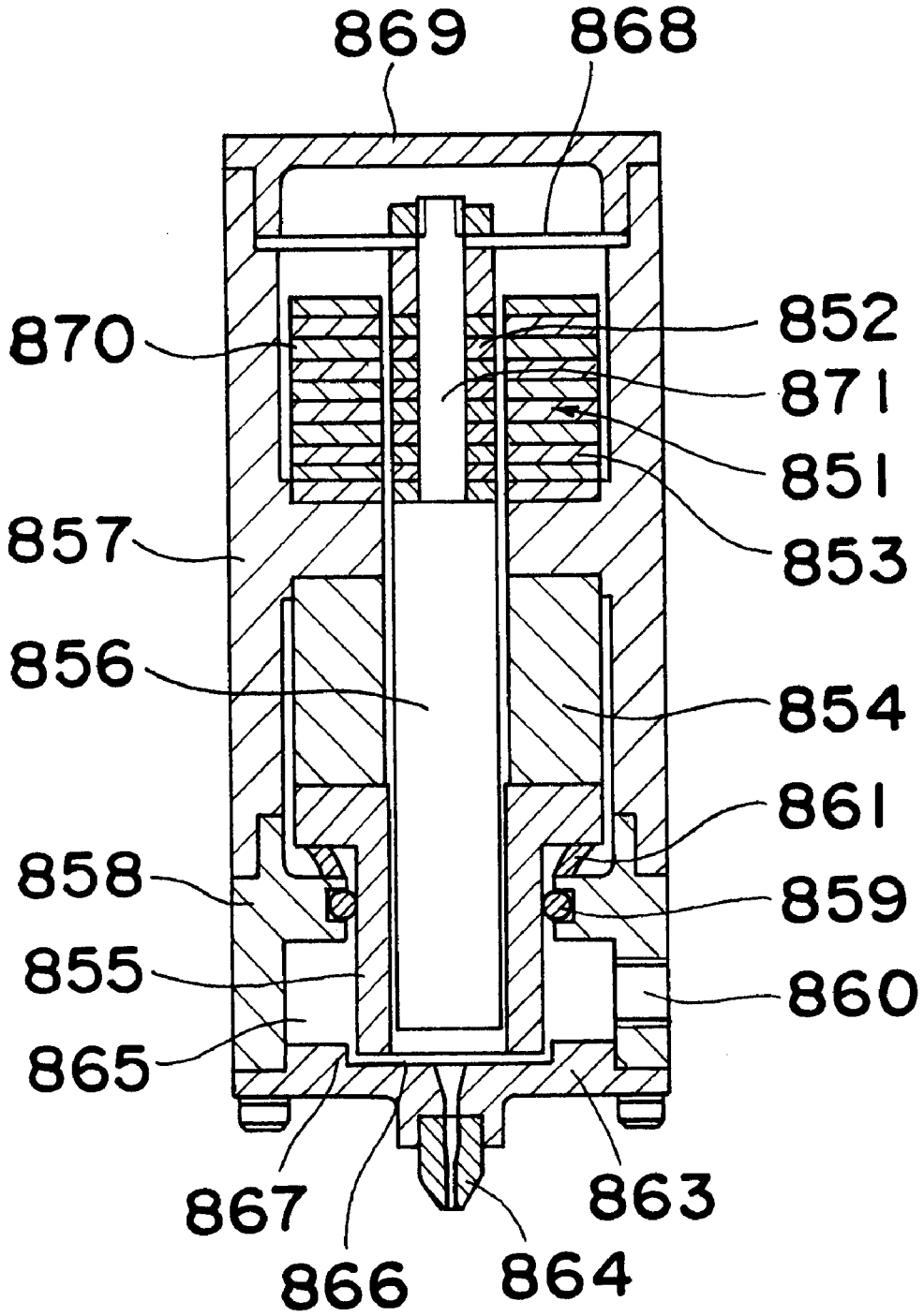
FIG. 11 is a cross-sectional front view illustrating a dispenser of a sixth embodiment of the present invention.

FIG. 11 illustrates a sixth embodiment of the present invention in which a linear motor is employed for driving a piston. Though stroke of a single electro-magneto-strictive element is limited to on the order of tens of micrometers, this stroke limit is eliminated by substitution of a linear motor for such an electro-magneto-strictive element.

Linear motors are inferior to electro-magneto-strictive elements in responsibility and developed load but can be adapted to usage where rapid response, small diameter and compactness are not so required.

Reference numeral 851 denotes an upper actuator that is composed of radially magnetized permanent magnets 852 and an electromagnetic coil 853 having U, V, and W phases formed alternately.

Numeral 854 denotes a lower actuator composed of a laminated piezoelectric element, numeral 855 denotes a movable sleeve, numeral 856 denotes a piston, numeral 857 denotes an upper housing, numeral 858 denotes a lower housing, numeral 859 denotes a contact seal, numeral 860 denotes a suction opening, numeral 861 denotes a bias spring, numeral 863 denotes a lower plate, numeral 864 denotes a discharge nozzle, numeral 865 denotes a fluid storing section, numeral 866 denotes a pump chamber, numeral 867 denotes a non-contact seal section, numeral 868 denotes a leaf spring, numeral 869 denotes an upper plate, and numeral 870 denotes an electromagnetic coil having U, V, and W phases arranged alternately.

For the permanent magnets 852, cylindrical manganese-aluminum magnets magnetized in different directions are alternately stacked around a small-diameter portion 871 of the piston 856.

In order to increase an area of suction flow passage for highly viscous fluid, a linear motor may be used on a side of the lower actuator 854 that drives the movable sleeve 855.

Figure 12:
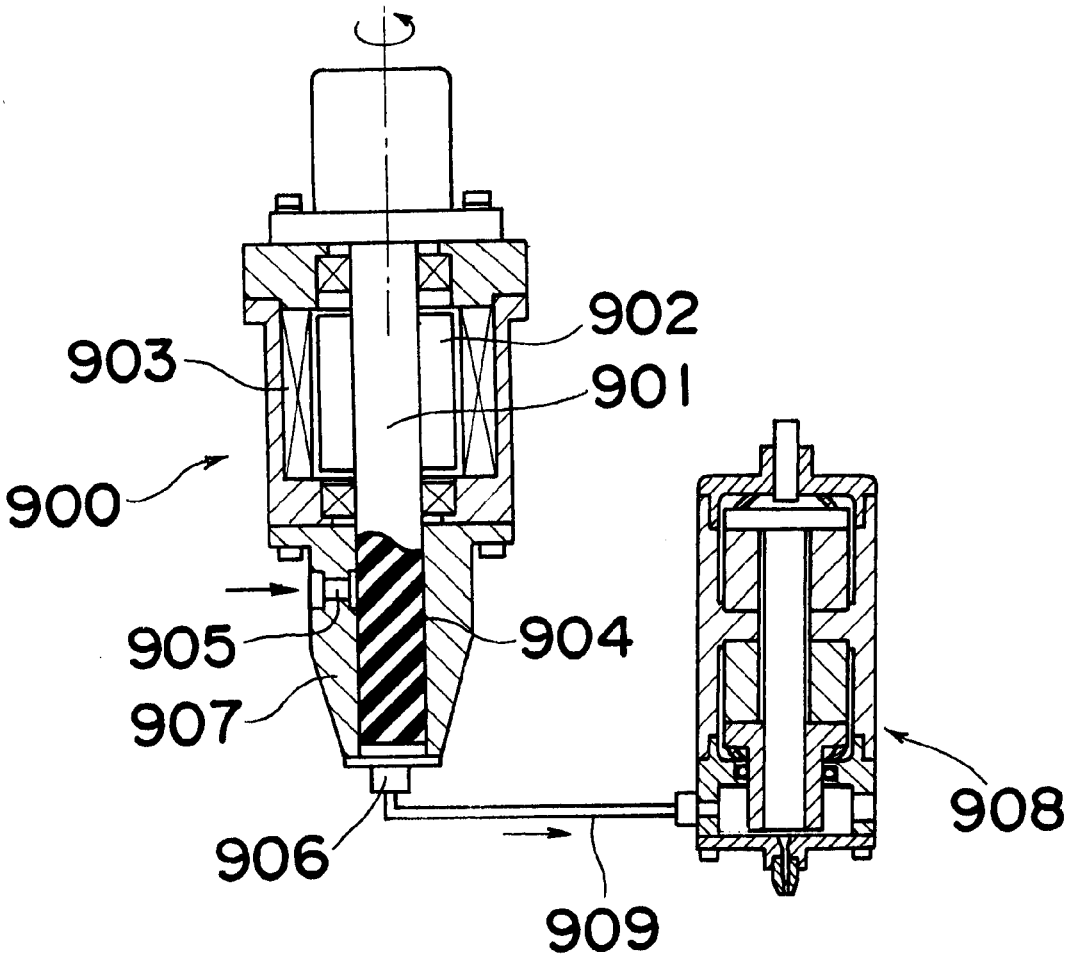
FIG. 12 is a cross-sectional front view illustrating a dispenser of a seventh embodiment of the present invention.

Hereinbelow, a seventh embodiment of the present invention will be described referring to FIG. 12.

In the seventh embodiment, a thread groove pump is provided on an upstream side in a flow passage for a dispenser to which the present invention is adapted, for the purpose of ensuring a feeding pressure of fluid to be sucked and decreasing a viscosity of the fluid.

For Theological fluid used as carrier fluid, a viscosity of such fluid is determined by a temperature and a rate of shear the fluid undergoes. The seventh embodiment takes advantage of the fact that, by virtue of a thixotropic fluid behavior of rheological fluid, a certain period of time is normally required for such fluid once having its viscosity decreased to recover its original viscosity. That is, in a stage immediately before fluid is fed to a microminiature dispenser of the seventh embodiment, the fluid is initially subjected to shearing and viscosity of the fluid is thereby decreased, with rotation of the thread groove pump.

Only one thread groove pump having a large outside diameter is required for a plurality of microminiature dispensers, and thus the pump does not interfere with a proper arrangement of a multi-nozzle fluid feeding system.

Reference numeral 900 denotes a thread groove pump as a master pump that is composed of a rotating shaft 901, a motor rotor 902, a motor stator 903, a thread groove 904 formed on the rotating shaft 901, a suction opening 905, a discharge opening 906, and a housing 907.

Numeral 908 denotes a microminiature dispenser that is a fluid feeding apparatus of the seventh embodiment. The thread groove pump 900 and the microminiature dispenser 908 communicate with each other through a feeding pipe 909.

A configuration of a fluid feeding system in which a plurality of microminiature dispensers of the seventh embodiment are arranged in parallel can be adapted, for example, to a process of applying fluorescent material or the like to a flat plate such as a CRT or PDP, or a process of applying electrode materials such as gold or silver or the like to PDPs. In this configuration, a common discharge passage on a suction side for material to be applied may be provided.

A discharge amount (and on-off switching) of each nozzle is highly flexible because each dispenser can be individually controlled. This feature ensures application with little loss of application material to a surface of a flat plate.

Otherwise, a multi-nozzle applying apparatus having a further simple configuration can be obtained where components of a plurality of dispensers are accommodated in a common housing (not shown).

Figure 13A:
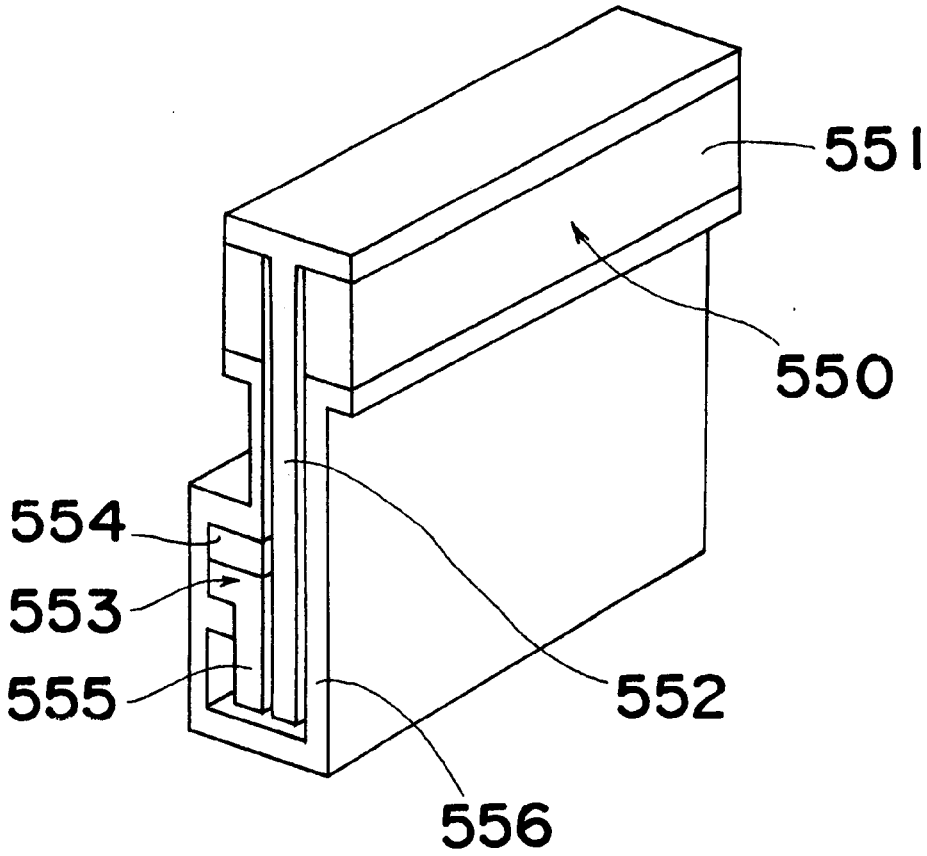
FIGS. 13A and 13B are a perspective view and a plane view, respectively, illustrating a multi-nozzle dispenser having a rectangular cross section of an eighth embodiment of the present invention.
Figure 13B:
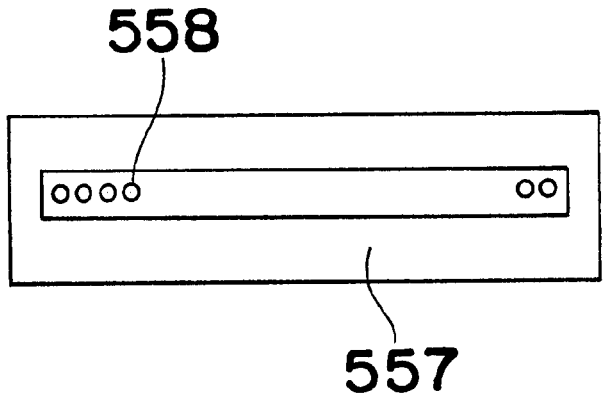

FIGS. 13A and 13B illustrate an eighth embodiment in which the present invention is adapted to a multi-nozzle applying unit having a piston with a rectangular cross section.

Reference numeral 550 denotes an upper actuator that is composed of laminated piezoelectric elements 551 and a piston plate 552. Numeral 553 denotes a lower actuator that is composed of a piezoelectric element 554 and a movable sleeve plate 555. Numeral 556 denotes a housing that accommodates the piston plate 552 and the movable sleeve plate 555. A plurality of discharge openings 558 are formed on a bottom surface 557 of the housing 556.

Figure 14:
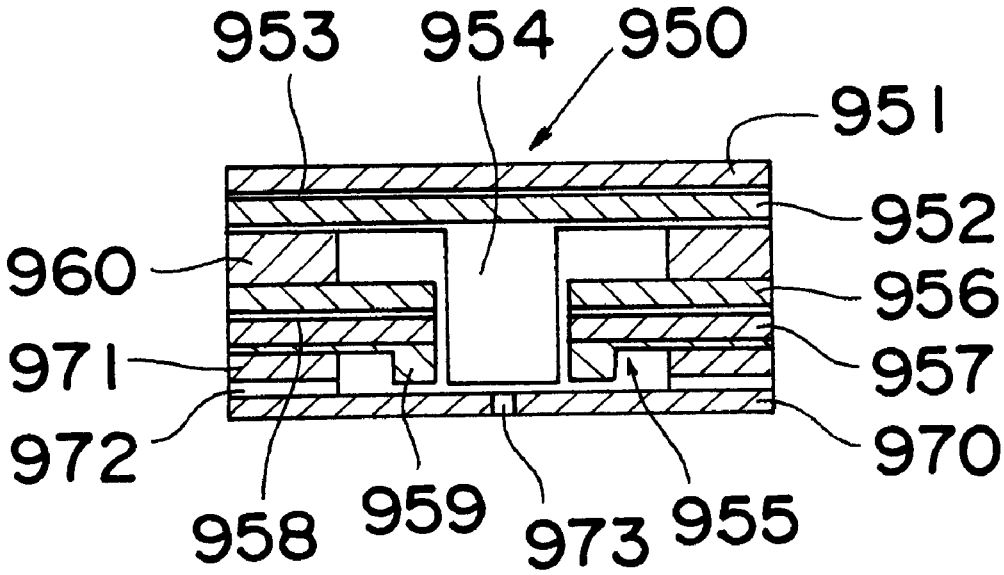
FIG. 14 is a cross-sectional front view of a microminiature dispenser employing piezoelectric elements of a bimorph type according to a ninth embodiment of the present invention.

With adaptation of principles of the present invention, a fluid discharge apparatus further microminiaturized and thinned can be obtained. FIG. 14 illustrates a ninth embodiment in which a dispenser is configured with use of piezoelectric elements of a bimorph type.

Reference numeral 950 denotes an upper actuator that is composed of piezoelectric ceramics 951 and 952, a metal shim 953, and a piston plate 954. Numeral 955 denotes a lower actuator that is composed of piezoelectric ceramics 956 and 957, a metal shim 958, and a movable sleeve plate 959. Numeral 960 denotes an upper fixing section interposed between the upper and lower actuators 950 and 955. A lower fixing section 971 is interposed between a lower plate 970 and the lower actuator 955. Numeral 972 denotes a suction opening formed along a bottom surface of the lower fixing section 971, and numeral 973 denotes a discharge opening formed on the lower plate 970.

In the description of the embodiments of the present invention, many examples in which an individual sensor is provided for detecting a position of a piezoelectric element have been presented.

Piezoelectric elements typified by piezoceramics and the like have both a piezoelectric effect of generating a voltage upon application of a strain (deformation) and an inverse piezoelectric effect of deforming upon the application of a voltage. At present, studies are being conducted on "Self-Sensing Actuation (abbreviated as SSA)" for the purpose of performing simultaneously sensing and actuating functions on strain (deformation) with simultaneous use of a piezoelectric effect and an inverse piezoelectric effect.

A strain voltage developed across a piezoelectric element is the sum of a component caused by a deformation of the element by an external force and a component caused by a deformation of the element by an applied voltage. A method has therefore been adopted in which a self-detected strain of a piezoelectric element is extracted with use of a bridge circuit.

This SSA method permits a fluid discharge apparatus of the present invention to have a further simple configuration (not shown).

The SSA method may be applied only to a movable sleeve, with aid of the fact that a position detecting accuracy on a side of the movable sleeve may be lower than that on a side of a piston, for example, as described with reference to the third embodiment.

The idea of SSA and its adaptation to the present invention may be applied to giant magnetostrictive elements having both a magnetostrictive effect and an inverse magnetostrictive effect.

The above embodiments have been contrived, taking notice of the fact that a positive displacement pump can be constituted by a combination of two independent linear-motion devices in consideration of phases of motion of these devices.

In a tenth embodiment that will be described below, a movable sleeve that is driven by a linear-motion device is further provided with a rotating function, and a function as a fluid feeding source is thereby integrated into one dispenser.

Figure 15:
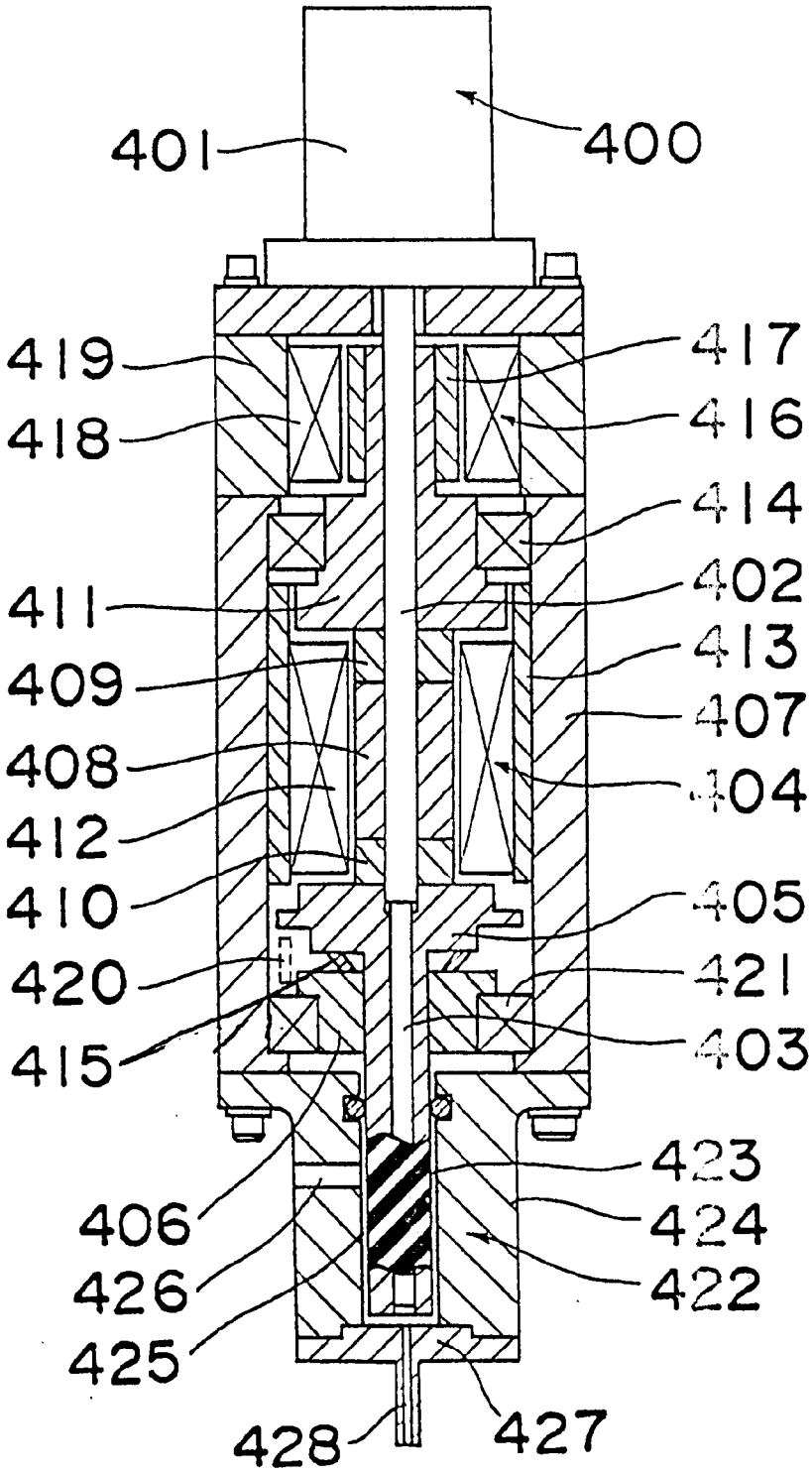
FIG. 15 is a cross-sectional front view of a dispenser with a thread groove pump according to a tenth embodiment of the present invention.

A structure of a dispenser shown in FIG. 15 is roughly composed of three driving sections and a pump section.

A first driving section is composed of a piezoelectric actuator and drives a piston. A second driving section is composed of a giant magnetostrictive element and drives a movable sleeve. The movable sleeve is farther provided with a rotating function, through use of a motor as a third driving section, with aid of a characteristic of giant magnetostrictive elements to which power can be delivered without contact. Thread grooves are formed on surfaces of the movable sleeve and of a housing which undergo relative movement. The pump section includes both a device for transporting fluid to a discharge side with rotation of the movable sleeve, and a flow rate controlling device for controlling a discharge amount with linear motion of the movable sleeve and of the piston.

Hereinbelow, the three driving sections will be described first. The first driving section 400 is composed of a piezoelectric actuator 401 (details of its structure are omitted), a piston 402 that forms a central shaft, and a small-diameter portion 403 of the piston 402. The second driving section 404 is a linear actuator (axial driving device) composed of a giant magnetostrictive element. Reference numeral 405 denotes a movable sleeve driven by the giant magnetostrictive element, numeral 406 denotes a rotating sleeve that accommodates a front side of the movable sleeve 405, and numeral 407 denotes a housing that accommodates the actuator 404. Numeral 408 denotes a cylindrical giant magnetostrictive rod composed of giant magnetostrictive material. The giant magnetostrictive rod 408 sandwiched between biasing permanent magnets (A) 409 and (B) 410 in a vertical direction is fixed between an upper rotating yoke 411 and the movable sleeve 405 that also serves as yoke material. Numeral 412 denotes a magnetic field coil for applying a magnetic field in a longitudinal direction of the giant magnetostrictive rod 408, and numeral 413 denotes a cylindrical yoke accommodated in the housing 407.

The biasing permanent magnets A and B previously apply a magnetic field to the giant magnetostrictive rod 408 to increase an operating point of the magnetic field, and form a closed-loop magnetic circuit linking the members 410→412→409→411→413→405→410 in the presented order, for controlling expansion and contraction of the giant magnetostrictive rod 408. That is, the members 405 and 408 to 413 constitute the linear actuator 404 capable of controlling axial expansion and contraction of the giant magnetostrictive rod with a current supplied for the magnetic field coil.

The piston 402 that is driven by the piezoelectric actuator 401 is provided so as to pierce the giant magnetostrictive rod 408 and the biasing permanent magnets (A) 409 and (B) 410. A top end of the upper rotating yoke 411 that accommodates the piston 402 so as to permit axial movement of the piston 402 is supported by a bearing 414 provided between a top end of the upper rotating yoke 411 and the housing 407.

A bias spring 415 for applying a mechanical and axial pressure to the giant magnetostrictive rod 408 is provided between the movable sleeve 405 and the rotating sleeve 406. With the above arrangement, application of a current to the electromagnetic coil 412 of the giant magnetostrictive element provides expansion or contraction of the giant magnetostrictive rod 408 proportional to the applied current.

Numeral 416 denotes a motor (the third driving section) that imparts a rotating motion to the upper rotating yoke 411, and a DC servomotor is employed in the embodiment. Numeral 417 denotes a motor rotor fixed to an outer surface of the upper rotating yoke 411. Numeral 418 denotes a motor stator, and numeral 419 denotes an upper housing that accommodates the motor stator 418. A rotating torque developed in the motor rotor 417 is transmitted through the upper rotating yoke 411, the magnet (A) 409, the giant magnetostrictive rod 408, and the magnet (B) to the movable sleeve 405.

A displacement sensor 420 for detecting a position of an end surface of the movable sleeve 405 is provided between the movable sleeve 405 and the housing 407 (fixed side). The rotating sleeve 406 that accommodates a part of a discharge side of the movable sleeve 405 is rotatably supported by a ball bearing 421 provided between the rotating sleeve 406 and the housing 407.

The piston 402, for which nonmagnetic material is used, exerts no influence upon a closed-loop magnetic circuit that controls expansion and contraction of the giant magnetostrictive rod 408. With the above arrangement, a rotational motion of the movable sleeve 405 and a linear motion with a minute displacement of the sleeve 405 can be controlled simultaneously and independently. The piston 402 provided so as to extend through the movable sleeve 405 is capable of making a linear motion with a minute displacement, entirely independent of motion of the movable sleeve 405.

In the embodiment, motive power for imparting a linear motion to the giant magnetostrictive rod 408 (and the movable sleeve 405) can be supplied from outside without contact, because the giant magnetostrictive element is employed as the linear actuator 404. That is, an actuator with this configuration is capable of moving the movable sleeve 405 axially with a fast response, with aid of a characteristic of electro-magneto-strictive elements having a frequency characteristic of a few megahertz, while the motor is running. In this embodiment, the third driving section is provided above the second driving section, and the first driving section is provided above the third driving section. Rotation of the piston 402 that is driven by the first driving section is not particularly required for a configuration of a positive displacement pump, and therefore the piezoelectric actuator can be employed for the piston.

Hereinbelow, the pump section 422 will be described. The pump section 422 is composed of members 421 to 428. Numeral 423 denotes radial grooves formed in an outer surface of the movable sleeve 405 for feeding fluid forcefully to a discharge side, and numeral 424 denotes a cylinder that accommodates the movable sleeve 405. Between the movable sleeve 405 and the cylinder 424 is formed a pump chamber (a fluid transporting chamber) 425 in which relative rotation of the movable sleeve and the cylinder provides a pumping action. In the cylinder 424 is formed a suction bore 426 communicating with the pump chamber 425. Numeral 427 denotes a discharge nozzle attached to a lower end portion of the cylinder 424, and numeral 428 denotes a discharge flow passage formed in the discharge nozzle 427.

In the dispenser with the above configuration, the two linear actuators 400 and 404 may be operated synchronously in consideration of phases of motion, for example, and one of the linear actuators may be provided with a rotating function. In the dispenser, therefore, a pump configuration of a positive displacement type can be employed as in the cases of the first to sixth embodiments, and a fluid replenishing device (a thread groove pump) for feeding high-pressure fluid can be integrated into the positive displacement pump section with use of a rotating function. In the seventh embodiment that has been described already, the independent thread groove pump is provided on an upstream side of the dispenser having two direct-acting actuators. In the tenth embodiment, however, the thread groove pump and the actuators can be unified.

With employment of a giant magnetostrictive actuator as the first driving section 400, the piston 402 could be caused to make a linear motion while being rotated in the same manner as the second driving section. This arrangement is advantageous with regard to reliability of sliding surfaces, because a relative speed between a movable sleeve (corresponding to the movable sleeve 405) and a piston (corresponding to the piston 402) might be zero even with a high-speed rotation of the movable sleeve.

In the above embodiment, a clearance for a thrust end surface on the discharge side of the movable sleeve 405 can be arbitrarily controlled with an axial positioning function for the movable sleeve 405 while a constant rotation of the movable sleeve 405 is maintained. This function ensures a flow rate control in which powder and granular material is released and shut off without contact, as proposed in Japanese Patent Application No. 2000-188899 titled "Fluid Feeding Apparatus and Fluid Feeding Method". That is, formation of a dynamic pressure seat on a surface that undergoes relative movements on a thrust end surface on the discharge side of the movable sleeve 405 makes it possible to shut off and release powder and granular material, without mechanical contact, in all sections of a flow passage extending from a suction opening to the discharge nozzle.

For formation of circuits, or in manufacturing processes of display panels such as PDPs and CRTs, for example, most of application materials used in these fields are powder and granular material containing minute particles. For example, conductive minute particles with a size on the order of 5 $\mu$m are encapsulated in adhesives used for resin sealing and the like of junctions in circuit formation. In fluorescent materials for a CRT, particle sizes of fluorescent substances are in the range from 7 to 9 $\mu$m.

Figure 16A:
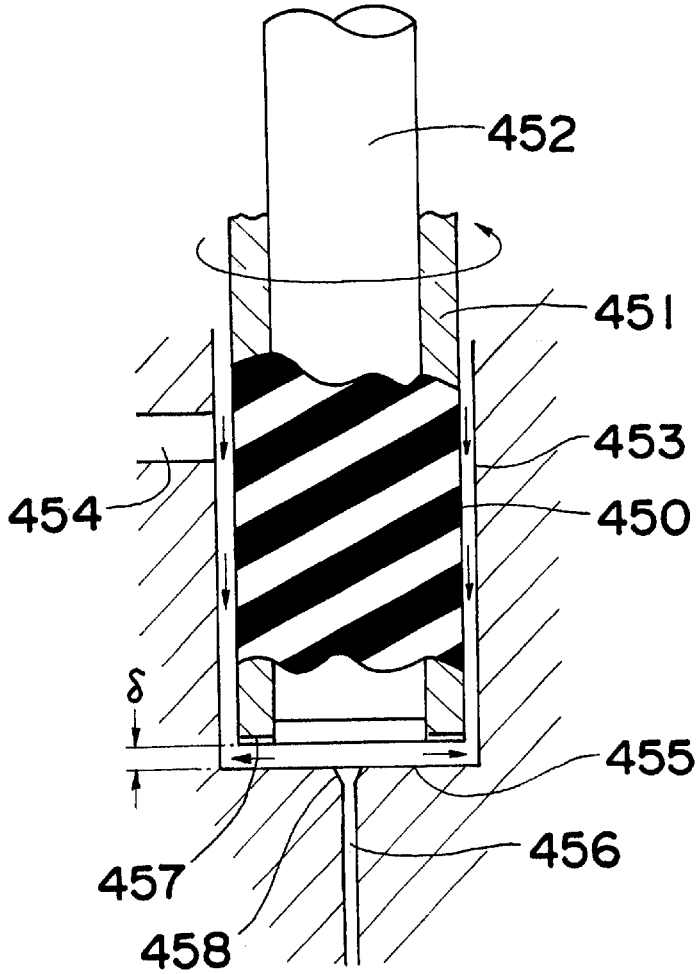
FIGS. 16A and 16B are model diagrams of a dispenser with a thrust dynamic pressure seal according to an eleventh embodiment of the present invention.
Figure 16B:
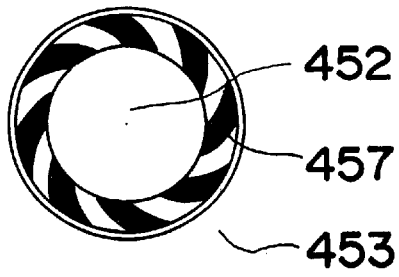

FIGS. 16A and 16B are figures of principles of a pump section alone in an eleventh embodiment of the present invention. Reference numeral 450 denotes radial grooves formed on an outer surface of a movable sleeve 451, numeral 452 denotes a central shaft, numeral 453 denotes a cylinder, numeral 454 denotes a suction bore, numeral 455 denotes a discharge nozzle, and numeral 456 denotes a discharge flow passage. Sealing thrust grooves 457 are formed on a surface that undergoes relative movement between an end surface of a discharge side of the movable sleeve 451 and a surface facing the end surface. An opening 458 of the discharge nozzle 455 is formed at a central portion of the surface facing the end surface on a discharge side. When a gap ($\delta$ in FIG. 16A) between the end surface of the movable sleeve 451 and the surface facing the end surface is small, the sealing thrust grooves 457 function effectively and interrupt discharge of fluid with pumping pressures developed in centrifugal directions (shown by arrows in FIG. 16A). Provided that a shape, number of revolutions, and the like of the sealing thrust grooves 457 are set so that an inequality $\delta > \phi d$ holds, wherein $\phi d$ is a particle size of minute particles contained in powder and granular material, fluid can be shut off without squeezing and breakage of the minute particles. When the movable sleeve 451 is raised so that the gap $\delta$ becomes sufficiently large, pumping pressures caused by the sealing thrust grooves 457 are reduced and fluid is released. In summary, the above arrangement provides a positive displacement dispenser that has a function of releasing and shutting off powder and granular material without contact.

In the above embodiments, the present invention is adapted to a positive displacement pump. That is, displacement curves of a movable sleeve and a piston are established so that a pump chamber becomes a closed space cut off from a suction side during a discharge stroke, with aid of the fact that the movable sleeve (cylinder) and the piston can be driven and controlled independently. The structures of fluid discharge apparatus of the present invention can be adapted to uses other than a positive displacement pump, with modifications of displacement curves of a movable sleeve and a piston. For example, the present invention can be adapted to a flow control valve having an extremely excellent dynamic characteristic, with a movable sleeve and a piston driven generally during opposite phases.

Hereinbelow, effects of a twelfth embodiment will be described in which the present invention is adapted to a flow control valve of a dispenser for drawing. A general structure of the dispenser is much the same as that of the first embodiment (in FIG. 4), for example, and therefore its details will be omitted.

Figure 17A:
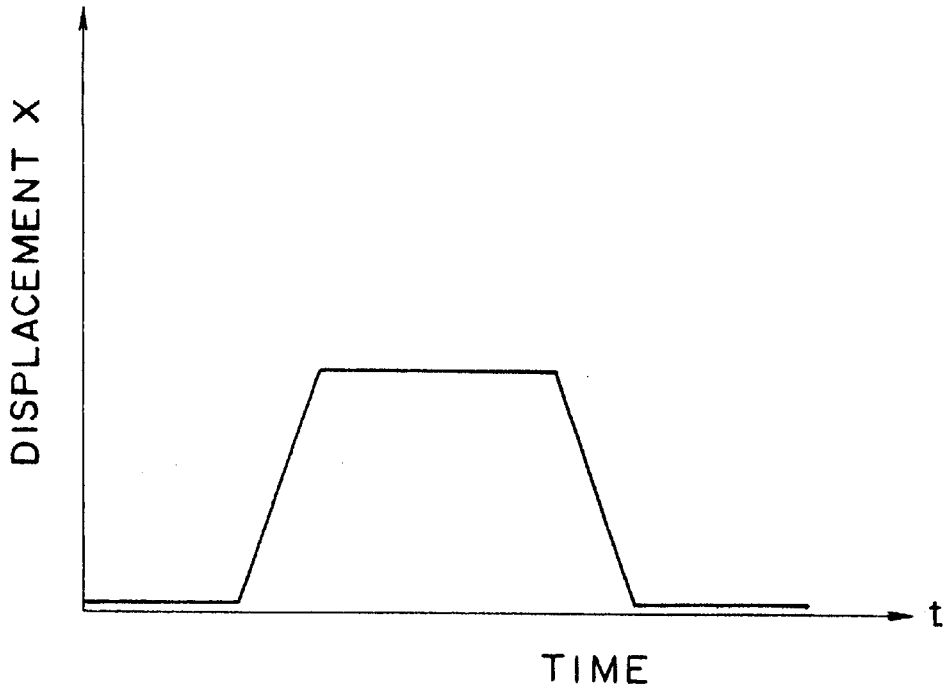
FIG. 17A is a graph illustrating displacement of a piston with respect to time.
Figure 17B:
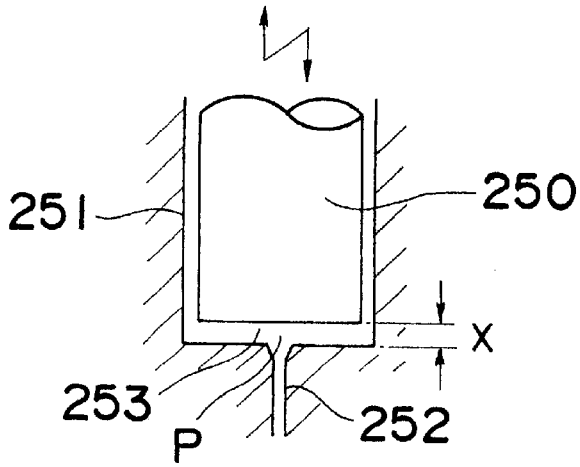
FIG. 17B is a model diagram of a conventional flow control valve.

FIG. 17A illustrates an example of displacement X of a piston with respect to time t in a conventional flow control valve, and FIG. 17B is a model diagram of the valve. Reference numeral 250 denotes a piston, numeral 251 denotes a housing, numeral 252 denotes a discharge nozzle, and numeral 253 denotes a pump chamber.

Figure 18A:
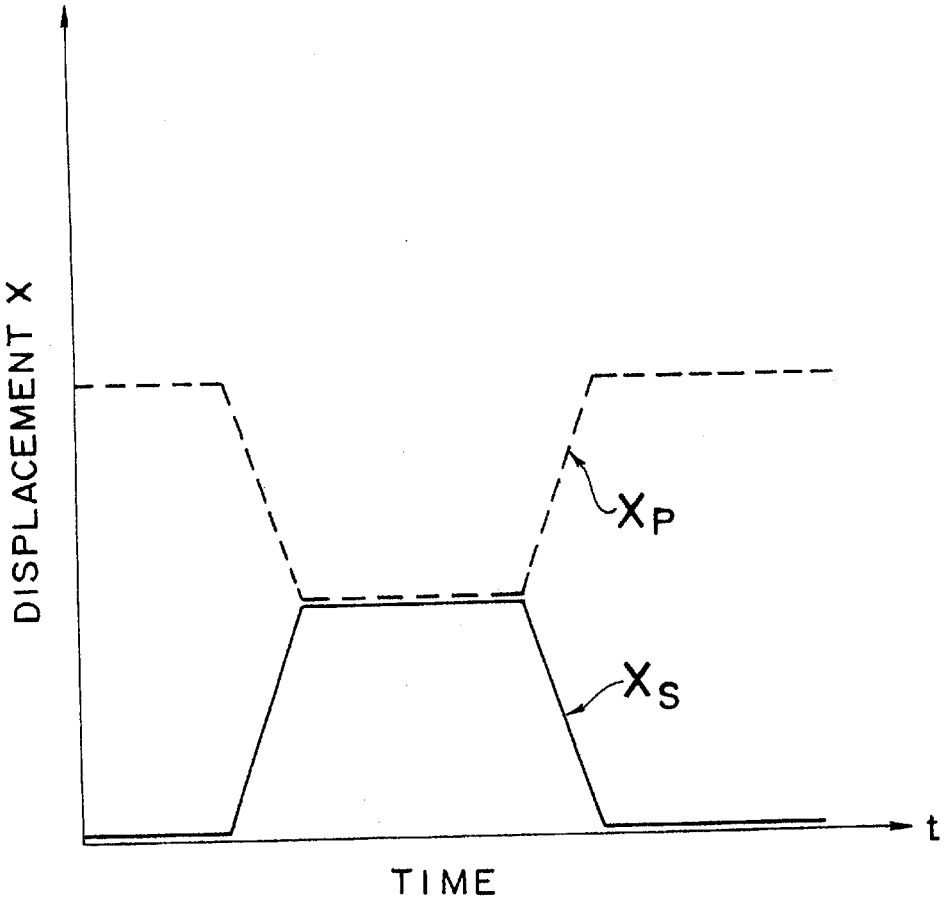
FIG. 18A is a graph illustrating displacement of a piston with respect to time.
Figure 18B:
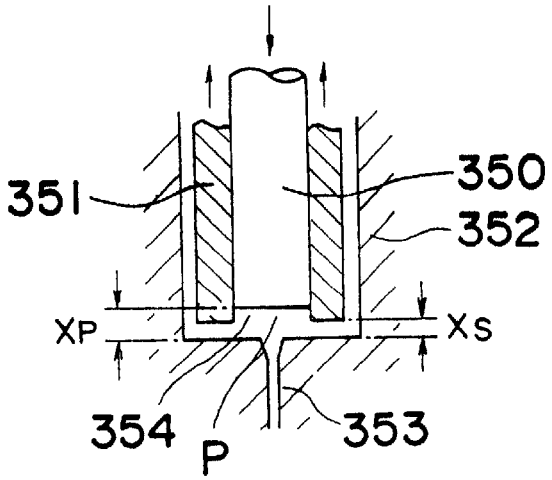
FIG. 18B is a model diagram of a: flow control valve according to a twelfth embodiment to which the present invention is adapted.
Figure 19:
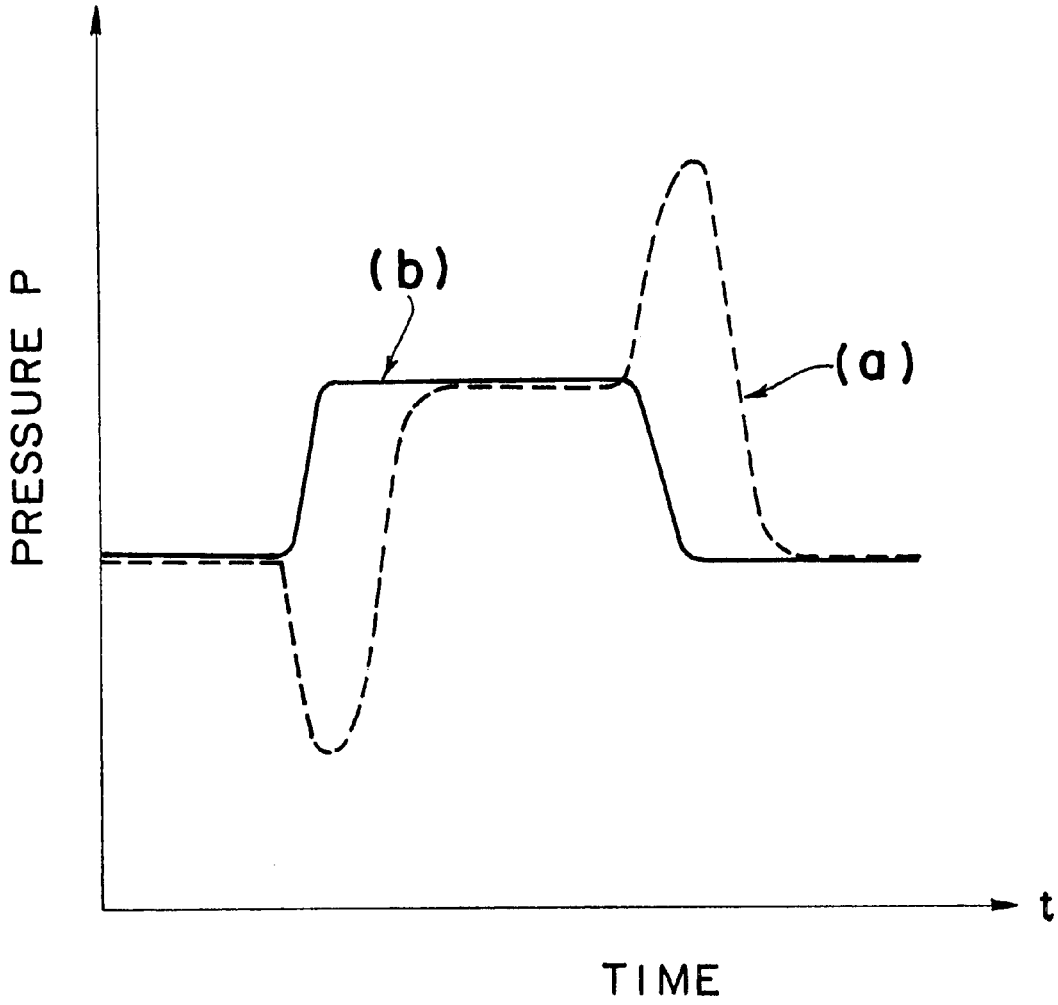
FIG. 19 is a graph comparing a pressure characteristic on an upstream side of a discharge nozzle in a conventional flow control valve with that in a flow control valve to which the present invention is adapted.

FIG. 18A illustrates an example of displacement Xp of a piston and displacement Xs of a movable sleeve with respect to time t in the valve to which the present invention is adapted. FIG. 18B is a model diagram of the valve. Numeral 350 denotes a piston, numeral 351 denotes a movable sleeve, numeral 352 denotes a housing, numeral 353 denotes a discharge nozzle, and numeral 354 denotes a pump chamber. FIG. 19 illustrates "a characteristic of pressure P on an upstream side of the discharge nozzle with respect to time" in the valve to which the present invention is adapted, in comparison with that in a conventional valve. When a gap X between the piston 250 and a surface facing the piston is increased for releasing fluid in a conventional valve shown in FIG. 17A, pressure P on an upstream side (in the pump chamber 253) of the discharge nozzle substantially drops as shown by (a) in FIG. 19 with an increase in capacity of the pump chamber 253. Development of negative pressure on the upstream side of the discharge nozzle may become a factor of "failure in drawing at a starting point of drawing" or "thinned drawn line". When the gap X in FIG. 17B is decreased for shutting off fluid, the pressure P on the upstream side of the discharge nozzle rises reversely and substantially. Development of this high pressure is caused by compression of fluid or an effect of dynamic pressure in a hydrodynamic bearing, which is referred to as a squeezing action. It has been observed that such a high pressure becomes a factor of "the development of liquid puddle" at an end point of drawing.

Figure 26:
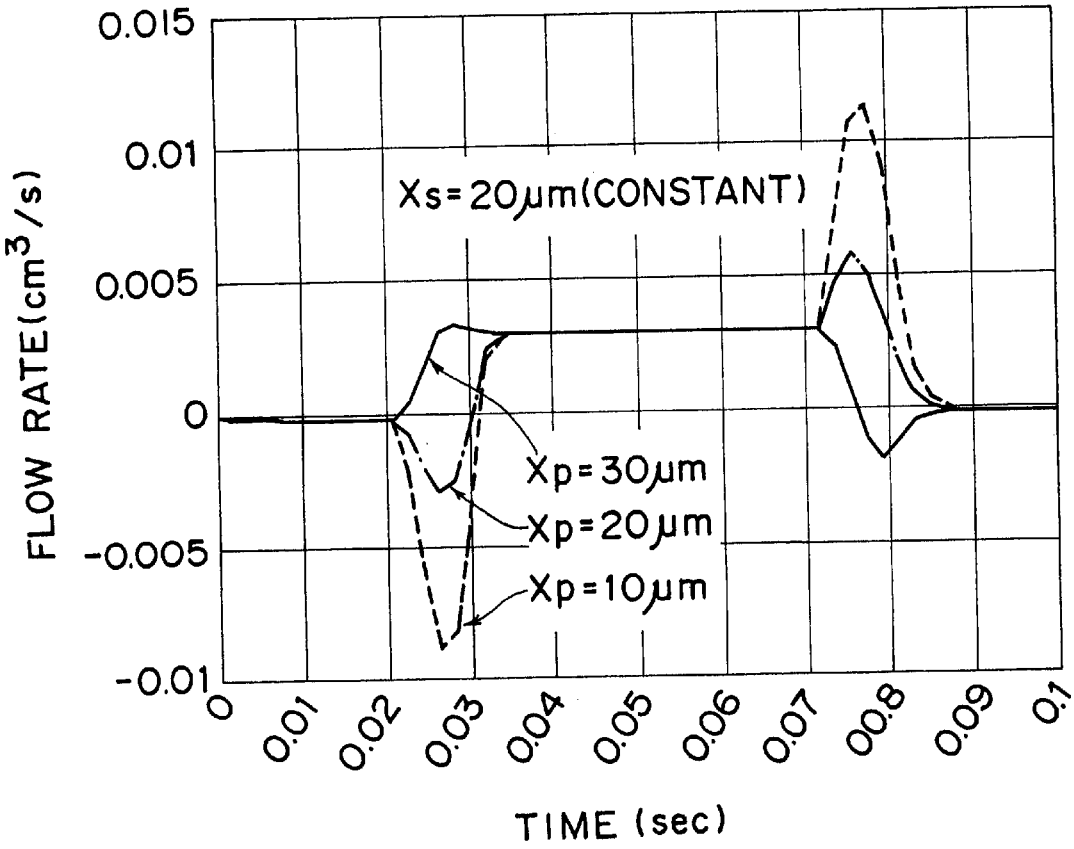
FIG. 26 is a graph showing a relationship (an analyzed result of transient characteristics of discharge flow rate) between flow rate and time in cases where displacements Xp are 10, 20, and 30 $\mu$m, while Xs is 20 $\mu$m, (constant) and where a sleeve radius rs is 3 mm, piston radius rp is 1.5 mm, and fluid viscosity $\eta$ is 10,000 CPS.

In the fluid control valve using a fluid discharge apparatus according to the present invention, the piston 350 and the movable sleeve 351 are driven during opposite phases, as shown in FIG. 18A. In this case, a change in capacity of the pump-chamber is canceled because motions of the piston and the movable sleeve in an axial direction are made during opposite phases. As a result, development of negative pressure at a starting point of drawing and development of high pressure at an end point of drawing are reduced as shown by (b) in FIG. 19, so that such troubles as "thinned drawn line" and "the development of liquid puddle" are eliminated. FIG. 26 is a graph showing a relationship (an analyzed result of transient characteristics of discharge flow rate) between flow rate and time in cases where displacements Xp of the piston 350 in FIG. 18B are 10, 20, and 30 $\mu$m, while displacement Xs of the movable sleeve 351 in FIG. 18B is 20 $\mu$m (constant), and where a radius of the movable sleeve 351 rs is 3 mm, a radius of the piston 350 rp is 1.5 mm, and fluid viscosity $\eta$ is 10,000 CPS. When the displacements Xp in FIG. 18B are 10, 20, and 30 $\mu$m, flow rates are poor, acceptable, and sufficient, respectively. Even at a time when the displacement Xp of the piston 350 in FIG. 18B is at its lowest point (i.e., Xp=Xpmin), an influence the existance of the piston 350 exerts upon a flow passage resistance (i.e., flow rate) might be decreased with Xpmin set sufficiently large. Drivers for driving first and second actuators may be independently provided, or the actuators may be driven in opposite phases by a single driver.

Even in a valve where shapes of an end surface on a discharge side of a piston or a movable sleeve, and a facing surface are not flat, issues conventional valves have can be eliminated by adaptation of the present invention to a valve as clearly seen from the effects of the present invention. For example, the present invention can be adapted to a valve configured with an acutely convex surface of a tip end of a piston, and with a concave facing surface. In such a valve, fluid is shut off by making the convex surface of the piston and the concave facing surface (on a fixed side) adjacent to each other. In contrast to the twelfth embodiment, accordingly, fluid is shut off in the event that a movable sleeve has ascended and the piston has descended, while fluid is released upon a reversed condition. In this case, an adequate setting is preferably made so that, at a time displacement Xs of the movable sleeve is at its lowest point (i.e., Xs=Xsmin), Xsmin is sufficiently large. In any case, a fine adjustment of displacement curves of the piston and the movable sleeve is preferably performed according to applied processes and a characteristic of material to be applied, for a purpose of obtaining most desirable drawn lines.

Figure 20:
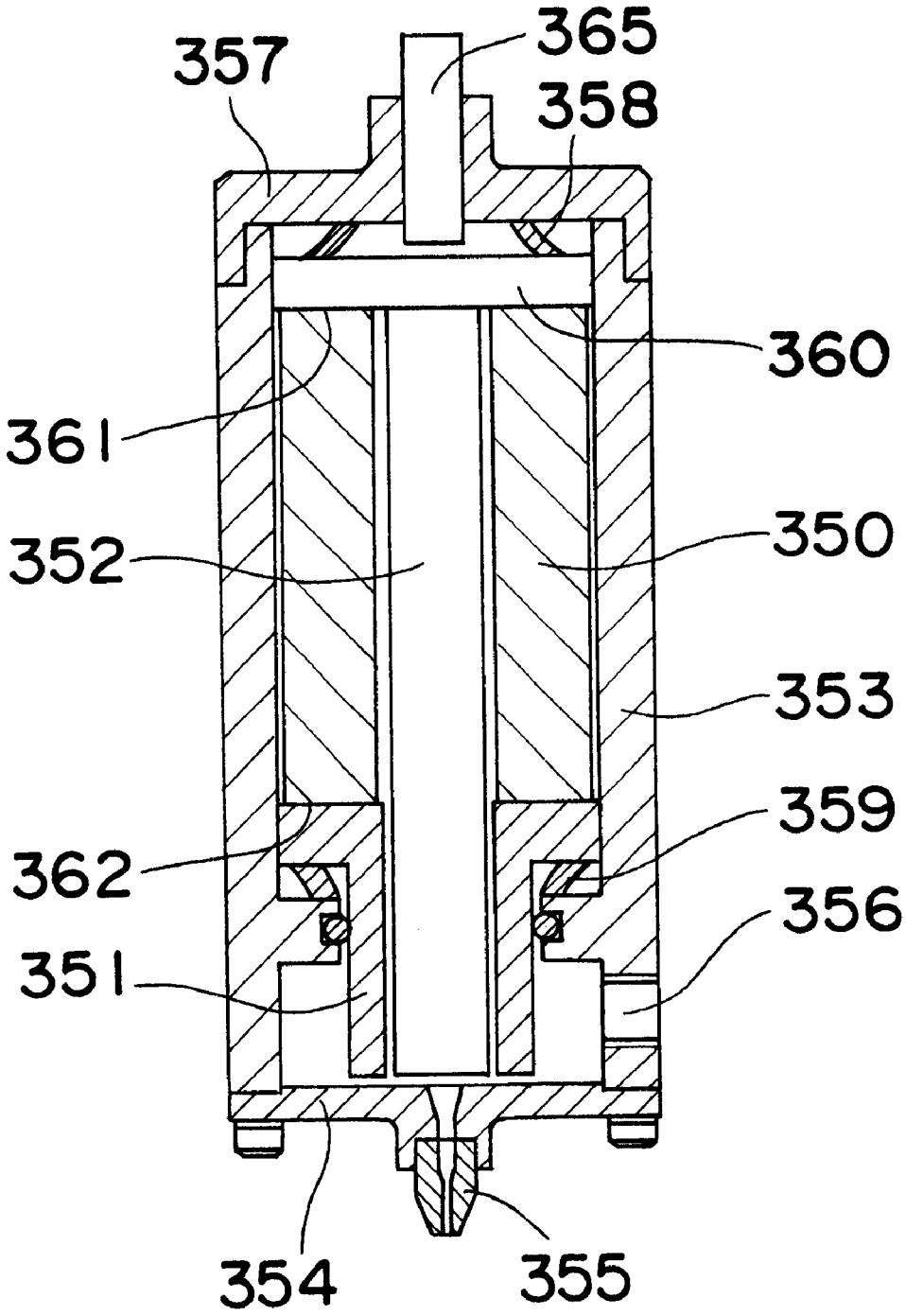
FIG. 20 is a cross-sectional front view of a flow control valve according to a thirteenth embodiment of the present invention.
Figure 21:
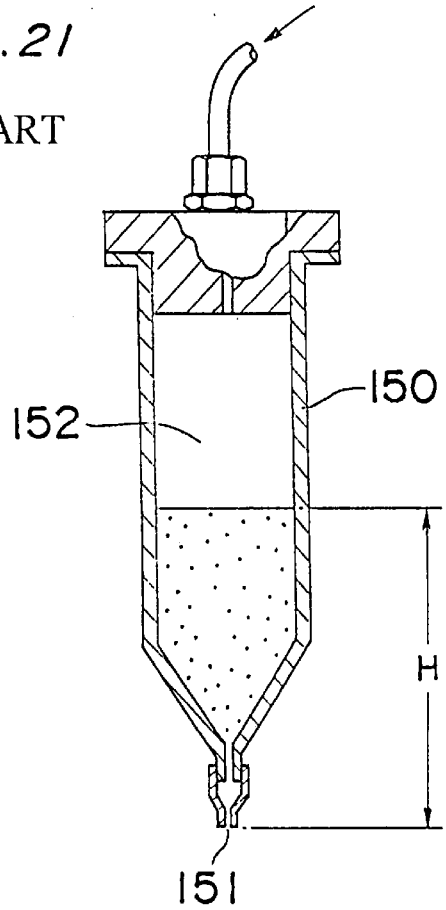
Fig. 21 PRIOR ART
FIG. 21 is a view illustrating a conventional dispenser employing an air pulse system.
Figure 22:
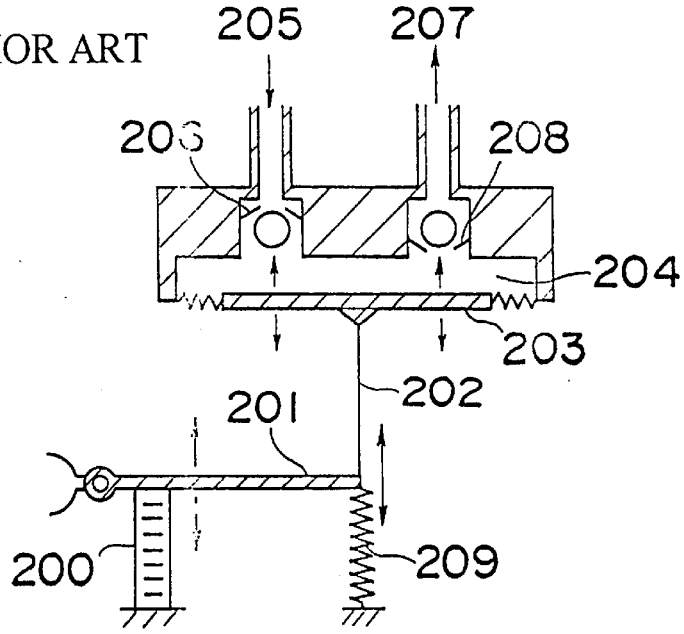
Fig. 22 PRIOR ART
FIG. 22 is a figure of principles of a conventional piezo-pump.
Figure 23:
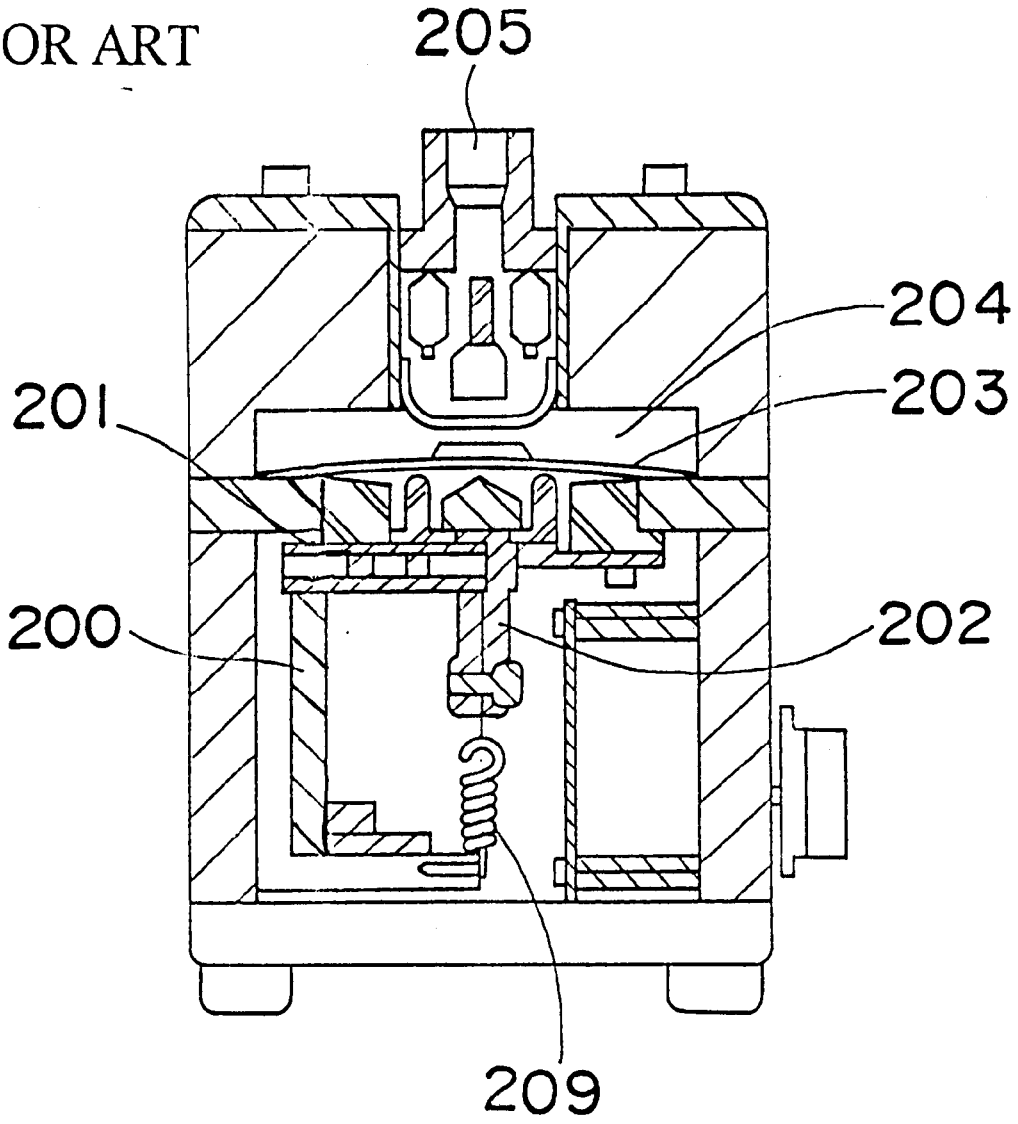
Fig. 23 PRIOR ART
FIG. 23 is a cross-sectional front view of the conventional piezo-pump of FIG. 22.
Figure 24:
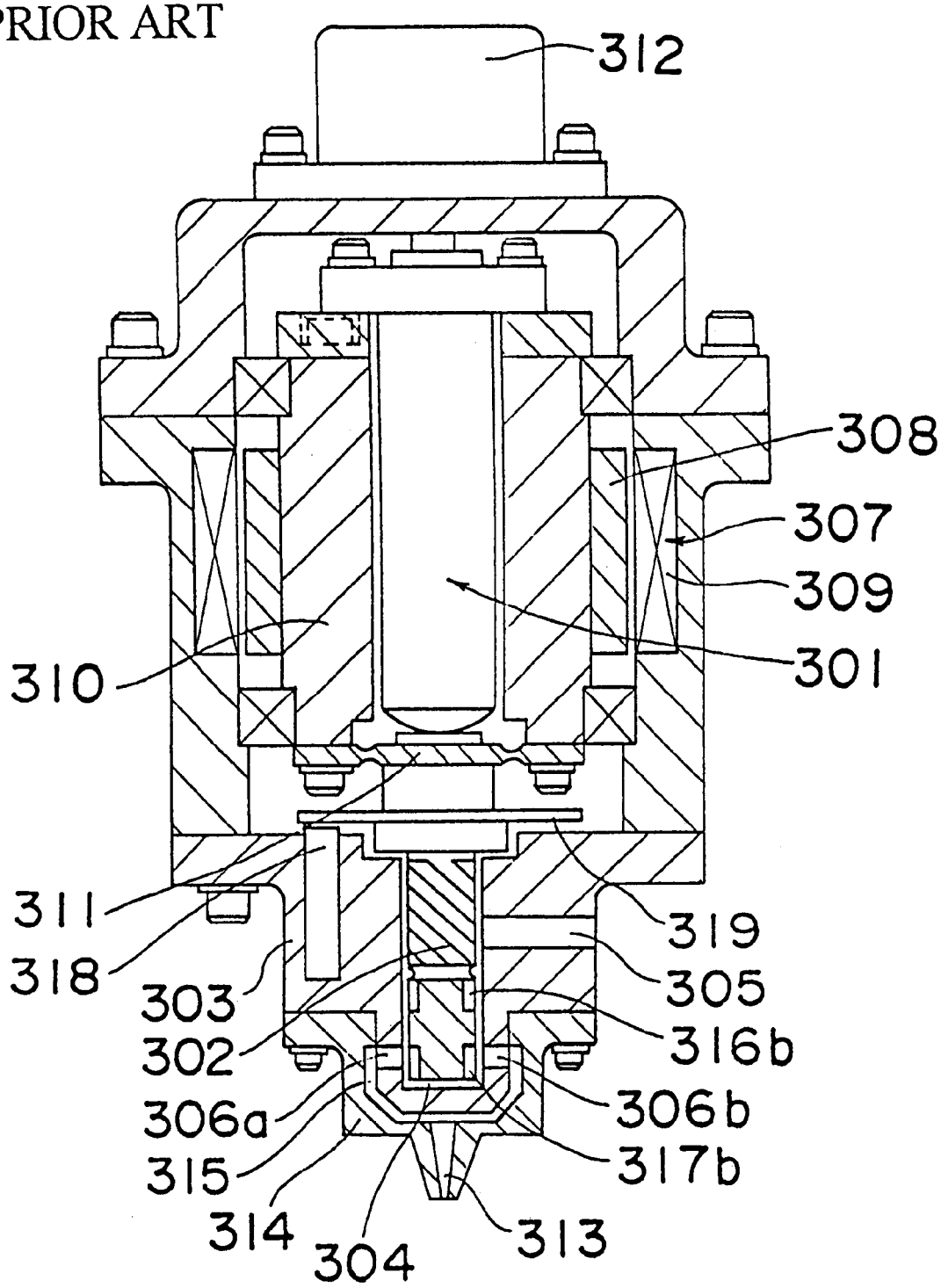
Fig. 24 PRIOR ART
FIG. 24 is a cross-sectional view of a conventional pump for a minute flow rate.

FIG. 20 illustrates a thirteenth embodiment of the present invention. In the thirteenth embodiment, a valve is configured with use of only one electro-magneto-strictive actuator, taking notice of the fact that a piston and a movable sleeve (cylinder) may be driven during opposite phases where the present invention is employed for a fluid control valve. That is, both end portions of one actuator that expands and contracts axially are supported by springs, and an output of one end of this actuator is used as a first actuator for driving a piston while output of the other end of the actuator is used as a second actuator for driving a cylinder.

Reference numeral 350 denotes an actuator composed of a laminated cylindrical piezoelectric element, numeral 351 denotes a movable sleeve (the cylinder) fixed to a lower end portion of the actuator 350, and numeral 352 denotes a piston fixed to an upper end portion of the actuator 350. Numeral 353 denotes a housing that accommodates the actuator 350. The piston 352 is accommodated so as to be movable axially through a central region of the actuator 350. Numeral 354 denotes a lower plate fixed to a lower end portion of the housing 353, numeral 355 denotes a discharge nozzle, numeral 356 denotes a suction bore, and numeral 357 denotes an upper plate. Numerals 358 and 359 denote upper and Sower bias springs for applying axial bias loads to the actuator (piezoelectric element) 350. The upper bias spring 358 is installed between the upper plate 357 and a piston plate 360 integral with the piston 352. The lower bias spring 359 is installed between the movable sleeve 351 and the housing 353. The bias springs 358 and 359 continuously exert an axial compressive stress on the electro-magneto-strictive element and thereby cancel a defect of electro-magneto-strictive elements, i.e., vulnerability to tensile stress in a case that repeated stress generated. Numeral 365 denotes a displacement sensor for detecting a position of the piston 352 in an axial direction.

Where stiffness of the upper bias spring 358 is sufficiently greater than that of the lower bias spring 359, the piston 352 does not move but only the movable sleeve 351 moves. Conversely, where stiffness of the lower bias spring 359 is sufficiently greater than that of the upper bias spring 358, the movable sleeve 351 does not move but only the piston 352 moves. Accordingly, an adequate setting of stiffnesses of both the springs 358 and 359 allows an arbitrary selection of displacement of the movable sleeve 351 and the piston 352, both of which are driven during phases opposite to each other. Herein, an output end portion 361 of the actuator 350 that drives the piston 352 is referred to as a first actuator, and an output end portion 362 of the actuator 350 that drives the movable sleeve 351 is referred to as a second actuator. A fluid control valve of this embodiment requires only one set of actuators and its driving source, and therefore allows an apparatus as a whole to be extremely compact, simple, and inexpensive.

Figure 25:
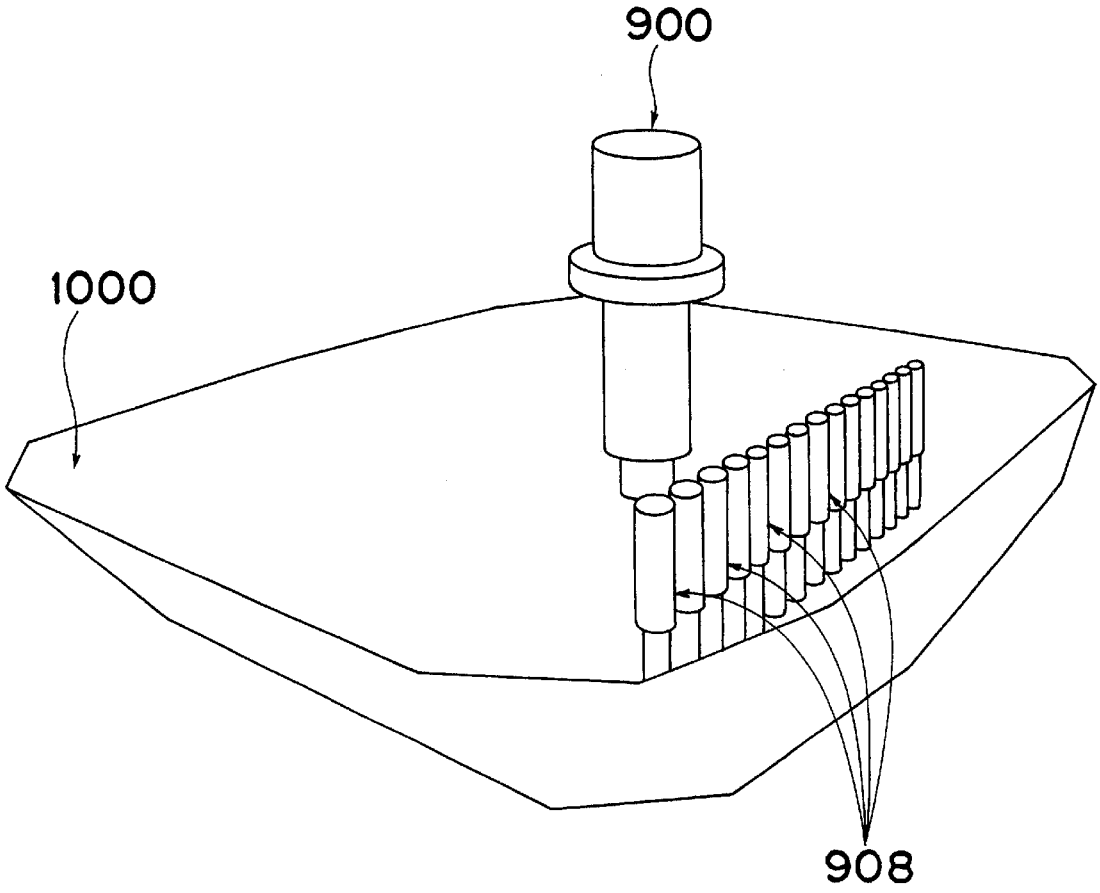
FIG. 25 is a perspective view of the dispenser of the seventh embodiment, including one thread groove pump and fifteen microminiature dispensers, which is used for application of a display onto a CRT or a PDP.

Multi-head application can be achieved with provision of a high-pressure feeding source of fluid on an upstream side of a plurality of fluid control valves in the same manner as shown in the seventh embodiment, for example, as shown in FIG. 25 where one thread groove pump 900 connected to fifteen microminiature dispensers 908 is used for application of a display 1000 such as a CRT. This multi-head applying apparatus of FIG. 25 can be used, for example, for an application process of a display panel that requires not less than one thousand lines of fluorescent material to be drawn. For example, first, when a multi-head applying apparatus for red fluorescent material is prepared as shown in FIG. 25, and relative movement between the piston and the housing, and between the cylinder and the housing, is respectively produced by the first and the second actuators, fluid that is red fluorescent material is sucked into the pump chamber. Thereafter, the pump chamber and a passage are blocked on a suction side by driving the second actuator. Then, the fluid is compressed in the pump chamber by driving the first actuator and the fluid, and thereby the fluid is lineally discharged to apply the fluid as 1000 red fluorescent material lines on a panel of a CRT. Next, when a multi-head applying apparatus for green fluorescent material is prepared as shown in FIG. 25, and relative movement between the piston and the housing, and between the cylinder and the housing, is respectively produced by the first and the second actuators, the fluid that is green fluorescent material is sucked into the pump chamber. Thereafter, the pump chamber and a passage are blocked on a suction side by driving the second actuator. Then, the fluid is compressed in the pump chamber by driving the first actuator and the fluid, and thereby the fluid is lineally discharged to apply the fluid as 1000 green fluorescent material lines on the panel of the CRT. Next, when a multi-head applying apparatus for blue fluorescent material is prepared as shown in FIG. 25, and relative movement between the piston and the housing, and between the cylinder and the housing, is respectively produced by the first and the second actuators, the fluid that is blue fluorescent material is sucked into the pump chamber. Thereafter, the pump chamber and the passage are blocked on a suction side by driving the second actuator. Then, the fluid is compressed in the pump chamber by driving the first actuator and the fluid, and thereby the fluid is lineally discharged to apply the fluid as 1000 blue fluorescent material lines on the panel of the CRT. The fluid control valve may have an outside diameter the size of a pencil, and thus the number of heads can be sufficiently large. As a result, an applying apparatus that achieves high production tact is obtained. Besides, an extremely compact flow control valve can be obtained with use of piezoelectric elements of a bimorph type, thin-film piezo elements, or the like, as shown in the ninth embodiment.

Any of the first to eleventh embodiments adapted to a positive displacement pump may be adapted to a flow control valve. In this case, a fluid feeding source for the flow control valve may be a pump of any form, and a method may be employed in which fluid is fed to a pump chamber with aid of air pressure.

As described above, the present invention can be adapted to various uses with an adequate selection of a phase relationship between Xp(t) and Xs(t), where Xp(t) is a displacement characteristic of a piston driven by a first actuator and Xs(t) is a displacement characteristic of a cylinder driven by a second actuator. In summary, (1) The present invention can be adapted to a positive displacement pump, provided that a displacement Xs(t) of a cylinder (movable sleeve) is set so that a passage on suction side is blocked after suction of fluid into a pump chamber, and thereafter a displacement Xp(t) of a piston is made to approach zero.

(2) The present invention can be adapted to a fluid control valve, provided that driving operations are carried out so that a displacement Xp(t) of a piston and a displacement Xs(t) of a cylinder have opposite phases.

The present invention can be adapted to a high-speed intermittent dispenser using a squeezing action, provided that driving operations are carried out so that a displacement Xp(t) of a piston and a displacement Xs(t) of a cylinder are the same phase as each other, or provided that only one of the piston and the cylinder is driven.

Types of actuators used in the present invention are not limited to the aforementioned electro-magneto-strictive type, magnetic type, and the like. For example, an apparatus body can be substantially miniaturized, providing that electrostatic actuator(s) having a large developed load relative to a given volume are employed as both or either of first and second actuators, with adaptation of principles of the present invention. That is, a micropump of positive displacement type or a flow control valve having a function of compensating for dynamic characteristic can be obtained for a first time in categories of micromachines and mini-machines (not shown).

The following effects are achieved by the fluid feeding apparatus employing the present invention.

1. A dispenser for an ultra-minute and fixed amount can be obtained, which dispenser has an extremely small diameter and a microminiature and simple structure.

2. An applying system can be obtained that is easily adapted so as to have a multi-nozzle configuration, and allows a flow rate in each nozzle to be controlled independently by virtues of above characteristics.

3. Fluid having a high viscosity can be discharged with high accuracy.

4. Intermittent application can be performed at an extremely high speed.

5. A high reliability is assured by absence of performance degradation that might be caused by sliding wear and the like.

6. Besides, a pump to which the present invention is adapted may also have the following characteristics because the pump can be a positive displacement type pump.

(1) A discharge amount is variable with stroke control.

(2) Thread-forming, fluid-dripping, and the like can be easily prevented.

(3) Continuous application can be performed within a limited time period with high accuracy.

(4) A discharge amount is independent of a change in environmental temperature (a change in viscosity), and independent of a gap between a nozzle and a surface for application.

(5) Powder and granular material mixed with minute particulate can be handled because non-contact piston parts can be provided.

7. For example, a dispenser capable of drawing with high accuracy at a beginning and an end of application is obtained, with use of the apparatus as a flow control valve.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid discharge apparatus comprising:

a housing;

a piston and a cylinder, said cylinder having a space extending therethrough in an axial direction thereof, and said cylinder accommodating at least part of said piston;

a first actuator on a first side of a fixing section, said first actuator being constructed and arranged to move in the axial direction so as to move said piston and said housing relative to one another; and a second actuator on an opposite second side of said fixing section, said second actuator being constructed and arranged to move in the axial direction so as to move said cylinder and said housing relative to one another, wherein said piston, cylinder and housing cooperate with one another to define a pump chamber which is in communication with an exterior of said pump chamber via a fluid suction opening and a fluid discharge opening.

2. The fluid discharge apparatus according to claim 1, wherein an end surface of said piston faces said pump chamber, and a discharge opening is provided in a surface that faces said end surface, with said end surface being movable relative to the surface in which said discharge opening is provided.

3. The fluid discharge apparatus according to claim 1, wherein said pump chamber is configured such that when said piston and housing move relative to one another a capacity of said pump chamber varies.

4. The fluid discharge apparatus according to claim 1, wherein said cylinder and said housing are configured such that when said cylinder and said housing move relative to one another and a fluid is traveling between said pump chamber and the exterior of said pump chamber, a resistance to this fluid varies.

5. The fluid discharge apparatus according to claim 1, wherein said piston includes a first portion having a first diameter and a second portion having a smaller second diameter, with said second portion being nearer to said pump chamber than is said first portion, an inner surface of said cylinder surrounds said second portion, with said inner surface defining a diameter that is less than the second diameter, and said piston and said cylinder are attachable and detachable.

6. The fluid discharge apparatus according to claim 1, wherein at least one of said first actuator and said second actuator is an actuator of an electro-magneto-strictive type.

7. The fluid discharge apparatus according to claim 6, wherein the actuator of the electro-magneto-strictive type comprises one of a piezoelectric element and a magneto-strictive element.

8. The fluid discharge apparatus according to claim 7, wherein an element of the actuator of the electro-magneto-strictive type and a control circuit for this element each are to function as an actuator and a displacement sensor.

9. The fluid discharge apparatus according to claim 1, further comprising a displacement sensor for detecting a relative axial position between said piston and said housing so as to control relative axial positioning between said piston and said housing.

10. The fluid discharge apparatus according to claim 1, further comprising a displacement sensor for detecting a relative axial position between said cylinder and said housing, said displacement sensor including a hollow rotor and a stator.

11. The fluid discharge apparatus according to claim 10, wherein said displacement sensor comprises a displacement sensor of a differential transformer type.

12. The fluid discharge apparatus according to claim 1, wherein an axial length of said first actuator is greater than an axial length of said second actuator.

13. The fluid discharge apparatus according to claim 12, wherein said first actuator comprises a plurality of actuators arranged along the axial direction.

14. The fluid discharge apparatus according to claim 1, wherein one of said first and second actuators comprises a magnetostrictive element, and the other of said first and second actuators comprises a piezoelectric element.

15. The fluid discharge apparatus according to claim 1, wherein at least one of said first and second actuators comprises at least one linear motor.

16. The fluid discharge apparatus according to claim 1, wherein said first actuator comprises a linear motor including a rod having one of laminated radially magnetized cylindrical magnets and laminated solid permanent magnets, and an electromagnetic coil that surrounds an outer circumference of said rod.

17. The fluid discharge apparatus according to claim 1, wherein said piston comprises a thin plate having a rectangular cross section.

18. The fluid discharge apparatus according to claim 1, wherein at least one of said first and second actuators comprise laminated piezoelectric elements each having a rectangular cross section.

19. The fluid discharge apparatus according to claim 1, wherein at least one of said first and second actuators comprise a thin-film piezo element.

20. The fluid discharge apparatus according to claim 1, wherein at least one of said first and second actuators is constructed and arranged to one of travel and, expand and contract, with aid of an exterior electromagnetic and non-contact power supplying device.

21. The fluid discharge apparatus according to claim 1, further comprising:

a third actuator for rotating said cylinder and housing relative to each other; and a pump device for feeding fluid to a discharge side, said pump device being formed on a surface of one of said cylinder and said housing.

22. The fluid discharge apparatus according to claim 21, wherein said pump device comprises a thread groove pump.

23. The fluid discharge apparatus according to claim 21, wherein said first actuator comprises a magnetostrictive element.

24. The fluid discharge apparatus according to claim 1, wherein said first actuator is to move said piston and said housing relative to one another during a phase that is opposite to a phase during which said second actuator is to move said cylinder and said housing relative to one another.

25. The fluid discharge apparatus according to claim 1, wherein said first actuator is to move said piston and said housing relative to one another during a phase which is opposite to a phase during which said second actuator is to move said cylinder and said housing relative to one another, such that when a high-pressure developing source for fluid is provided on an upstream side of the fluid discharge apparatus said piston and said cylinder are to function as a fluid control valve to release or shut off the fluid.

26. The fluid discharge apparatus according to claim 1, wherein the fluid is fluorescent material or electrode material.

27. The fluid discharge apparatus according to claim 1, wherein the fluid is fluorescent material when the fluid is to be discharged onto a CRT.

28. The fluid discharge apparatus according to claim 1, wherein the fluid is electrode material when the fluid is to be discharged onto a plasma display panel.

29. A fluid discharge system comprising:

an enclosure section accommodating plural fluid discharge apparatus, each said plural fluid discharge apparatus including (i) a housing, (ii) a piston and a cylinder, said cylinder having a space extending therethrough in an axial direction thereof, and said cylinder accommodating at least part of said piston, (iii) a first actuator on a first side of a fixing section, said first actuator being constructed and arranged to move in the axial direction so as to move said piston and said housing relative to one another, and (iv) a second actuator on an opposite second side of said fixing section, said second actuator being constructed and arranged to move in the axial direction so as to move said cylinder and said housing relative to one another, wherein said piston, cylinder and housing cooperate with one another to define a pump chamber which is in communication with an exterior of said pump chamber via a fluid suction opening and a fluid discharge opening; and a fluid feeder for feeding fluid to said enclosure section.

30. The fluid discharge system according to claim 29, further comprising a common fluid feeding passage that communicates with said pump chamber of each of a plurality of said plural fluid discharge apparatus.

31. The fluid discharge system according to claim 29, wherein at least one of said first and second actuators of each of said plural fluid discharge apparatus comprises magnetostrictive elements, and further comprising in said enclosure section a common cooling passage for cooling magnetic field coils.

32. A fluid discharge apparatus comprising:

a housing;

a piston and a cylinder, said cylinder having a space extending therethrough in an axial direction thereof, and said cylinder accommodating at least part of said piston; and an actuating member having opposite end portions thereof supported by springs, respectively, said actuating member being constructed and arranged to expand and contract such that one of said end portions is to function as a first actuator by moving in the axial direction so as to move said piston and said housing relative to one another, and such that the other of said end portions is to function as a second actuator by moving in the axial direction so as to move said cylinder and said housing relative to one another, wherein said piston, cylinder and housing cooperate with one another to define a pump chamber which is in communication with an exterior of said pump chamber via a fluid suction opening and a fluid discharge opening.

33. A fluid discharge method comprising:

in a first fluid discharge apparatus, producing, by driving first and second actuators, relative movement between a piston and a housing and between a cylinder and the housing, respectively, to open a pump chamber defined by said piston, said cylinder and said housing, thereby sucking fluid into said pump chamber; then blocking said pump chamber and a passage on a suction side by driving said second actuator; and then compressing the fluid in said pump chamber by driving said first actuator and the fluid, thereby discharging the fluid.

34. The fluid discharge method according to claim 33, wherein in producing the relative movement by driving said first and second actuators, said first and second actuators move in the same axial direction.

35. The fluid discharge method according to claim 33, wherein in producing the relative movement by driving said first and second actuators, a capacity of said pump chamber is changed in response to the relative movement between said piston and said housing.

36. The fluid discharge method according to claim 33, wherein in producing the relative movement by driving said first and second actuators, relative rotation between said cylinder and said housing is produced to feed the fluid to a discharge side along a surface of one of said cylinder and housing.

37. The fluid discharge method according to claim 33, wherein the relative movement is produced by driving said first and second actuators by axially expanding and contracting opposite end portions of an actuating member, which end portions are supported by springs, such that output of one of said end portions corresponds to driving said first actuator and output of the other of said end portions corresponds to driving said second actuator.

38. The fluid discharge method according to claim 33, including driving said cylinder and said piston, as a fluid control valve, during opposite phases so as to cancel a change in a capacity of said pump chamber to release or shut off the fluid.

39. The fluid discharge method according to claim 33, wherein producing the relative movement by driving said first and second actuators results in red fluorescent material being sucked into said pump chamber; and after blocking said pump chamber and said passage on the suction side by driving said second actuator, compressing the fluid in said pump chamber by driving said first actuator and the fluid results in the red flourescent material being linearly discharged onto a panel of a CRT, said method further comprising:

in a second fluid discharge apparatus (i) producing, by driving first and second actuators, relative movement between a piston and a housing and between a cylinder and the housing, respectively, to open a pump chamber defined by said piston, said cylinder and said housing, thereby sucking green fluorescent material into said pump chamber; then (ii) blocking said pump chamber and a passage on a suction side by driving said second actuator; and then (iii) compressing the green fluorescent material in said pump chamber by driving said first actuator and the green fluorescent material, thereby linearly discharging the green fluorescent material onto said panel of said CRT; and in a third fluid discharge apparatus (i) producing, by driving first and second actuators, relative movement between a piston and a housing and between a cylinder and the housing, respectively, to open a pump chamber defined by said piston, said cylinder and said housing, thereby sucking blue fluorescent material into said pump chamber; then (ii) blocking said pump chamber and a passage on a suction side by driving said second actuator; and then (iii) compressing the blue fluorescent material in said pump chamber by driving said first actuator and the blue fluorescent material, thereby linearly discharging the blue fluorescent material onto said panel of said CRT.

40. The fluid discharge method according to claim 33, wherein the fluid is fluorescent material or electrode material.

41. The fluid discharge method according to claim 33, wherein the fluid is fluorescent material when the fluid is discharged onto a CRT.

42. The fluid discharge method according to claim 33, wherein the fluid is electrode material when the fluid is discharged onto a plasma display panel.

* * * * *